US005553412A

United States Patent [19]

Briechle et al.

[11] Patent Number: 5,553,412

[45] Date of Patent: Sep. 10, 1996

[54] INFORMATION DISPLAY RAIL SYSTEM

[75] Inventors: George T. Briechle, New Canaan; David H. Lubowe, Westport; Alfred D. Dobras, Trumbull; Raymond F. DeLuca, Stamford, all of Conn.; Marvin Ackerman, Sunnyvale, Calif.

[73] Assignee: Electronic Retailing Systems International, Inc., Wilton, Conn.

[21] Appl. No.: 36,950

[22] Filed: Mar. 25, 1993

[51] Int. Cl.[6] ..... G09F 3/18

[52] U.S. Cl. ..... 40/642; 40/463

[58] Field of Search ..... 40/642, 1.6, 447, 40/448, 463; 248/221.4; 345/1, 2, 3

[56] References Cited

U.S. PATENT DOCUMENTS

| | | | |
|---|---|---|---|
| 2,822,631 | 2/1958 | Lynch | 40/5 |
| 4,002,886 | 1/1977 | Sundelin . | |
| 4,346,453 | 8/1982 | Drapeau et al. . | |
| 4,500,880 | 2/1985 | Gommersall et al. | 345/50 X |
| 4,557,064 | 12/1985 | Thompson | 40/642 |
| 4,654,514 | 3/1987 | Watson et al. . | |
| 4,766,295 | 8/1988 | Davis et al. . | |
| 4,783,740 | 11/1988 | Ishizawa et al. . | |
| 4,821,291 | 4/1989 | Stevens et al. . | |
| 4,888,709 | 12/1989 | Revesz et al. . | |
| 4,939,861 | 7/1990 | Soubliére | 40/651 |
| 4,962,466 | 10/1990 | Revesz et al. . | |
| 5,019,811 | 5/1991 | Olsson et al. . | |
| 5,044,104 | 9/1991 | Hopperdietzel | 40/649 X |
| 5,111,196 | 5/1992 | Hunt | 345/55 X |
| 5,160,920 | 11/1992 | Harris | 345/52 |
| 5,172,314 | 12/1992 | Poland et al. . | |
| 5,198,644 | 3/1993 | Pfieffer et al. . | |
| 5,233,773 | 8/1993 | Reynolds | 40/642 |
| 5,241,467 | 8/1993 | Failing et al. . | |
| 5,245,534 | 9/1993 | Waterhouse et al. . | |

FOREIGN PATENT DOCUMENTS

| | | | |
|---|---|---|---|
| 272414 | 1/1967 | Australia | 40/642 |
| 299355 | 1/1989 | European Pat. Off. . | |
| 0396414 | 3/1990 | European Pat. Off. . | |
| 2189640 | 10/1987 | United Kingdom | 40/642 |
| 2197564 | 5/1988 | United Kingdom . | |
| 2228812 | 5/1990 | United Kingdom . | |
| 2249854 | 5/1992 | United Kingdom . | |
| WO92/20056 | 11/1992 | WIPO | 40/642 |
| WO/9305456 | 3/1993 | WIPO . | |
| 9305475 | 3/1993 | WIPO . | |
| WO93/19448 | 9/1993 | WIPO . | |

*Primary Examiner*—Joanne Silbermann
*Attorney, Agent, or Firm*—Oppendahl & Larson

[57] ABSTRACT

An improved electronic price display system has rails into which are installed price display labels. Ridges along the top and bottom of the rails are shaped to receive a label readily. A removal tool may be engaged to release the pawls of the label to extract the label. Ridges at the rear of the rails, together with a resilient insert, permit quick mounting to a shelf with a minimal number of fasteners. A hemicylindrical feature at the back of the rails permits generous area of contact with a mounting screw having a hemispherical head. Opposed groove features permit the concealment of the screw heads and provide a visual design element.

Angled ridges on the rear face of the label engage with knurls on the rails providing contact wiping, enhancing electrical integrity of the label-to-rail connection, and also fix the label in place.

A feature along an edge of the rail provides a cylindrical concavity. An optional clear plastic cover mounted with a cylindrical edge bead in the concavity provides a hinged connection therebetween. A protruding button on the face of the label is actuated by the pressing of the cover in the vicinity of the button.

A subassembly of the label provides a robust carrier for springy contacts providing electrical connection long conductors on the rails.

60 Claims, 10 Drawing Sheets

INFORMATION DISPLAY RAIL SYSTEM

BACKGROUND OF THE INVENTION

Much attention has been given in recent years to the development of systems that would permit the electronic display of prices to customers in self-service stores at the shelves where goods are kept. Such a system, if commercially viable, offers many advantages over the manual posting of prices. Chief among those advantages is that one may have a high degree of confidence that the price computed by the scanner at the checkout counter will match the price that was provided to the customer at the shelf. Another salient advantage is that price changes, due, for example, to sale markdown or price increase or decrease, may be promulgated to the shelf automatically and reliably.

The store in which an electronic price display system is to be installed will typically have a number of gondolas, each having shelves on two sides. The gondolas define aisles in the store. Installation of the electronic price display system will typically call for mounting a rail on the outside edge of each shelf. Each shelf is typically four feet in length, so the corresponding rails are typically four feet in length as well. The shelves extend horizontally. Each rail contains power and data wiring (called a power and data bus), and the power and data buses of the rails are combined and brought together at gondola controllers. Signals from the gondola controllers are combined and communicated to a central computer (called a host). Attached to each rail are a number of electronic price display labels. Each display connects to the power and data bus, and has a liquid-crystal display (LCD). Electronic circuitry in the label responds to messages on the bus by driving the LCD appropriately.

To implement a price change, the host sends messages to the gondola controllers, which in turn communicate corresponding messages to the price display labels. Each label is separately addressable which permits the host to change the information on a single label, if desired, among the several tens of thousands of labels in the store. The manner of communication between host and labels can be that described in U.S. Pat. No. 5,172,314.

Power is distributed to the labels via conductors. Protection against inadvertent shorts in the power distribution wiring may be provided as described in copending U.S. application Ser. No. 07/757,259.

The features of the electronic price display system described herein are largely mechanical in nature. The electronic and software aspects of the electronic price display system may be selected from among those described in copending U.S. application Ser. Nos. 07/757,260, 07/757,675, and 07/876,198. The manner in which labels are installed to and removed from a rail as described herein differs in several respects from that described in copending U.S. patent application Ser. No. 07/965,877.

As will be appreciated, a typical hardware complement for a grocery store might be as follows: 1 central computer (host); eight gondola controllers, 2000 four-foot rail sections, and 30,000 label displays. Cost optimization greatly favors reducing the unit cost of the labels and the rails, even if this increases the unit cost of the host or gondola controllers.

In tension with the goal of cost optimization is the requirement that the system be highly reliable. Reliability requires mechanical and electrical integrity for the labels and rails. While a number of conditions affecting reliability in other settings, such as temperature, humidity, and corrosiveness of the atmosphere, tend to be well controlled in most stores, an electronic price display system for use in a retail store is exposed to other risks. The aisles of a grocery store, for example, present hostile conditions such as the predations of shopping carts, small children, and wagons used in transporting goods for restocking. Although a number of investigators have set up experimental electronic price display systems in actual retail stores, many of the experiments have been less than successful, leading to abandonment of a number of label and rail mechanical configurations that have proven too fragile for the store conditions. With many electronic price display systems it is all too easy for a shopping cart to slam into a label, for example, knocking the label off the rail or disrupting the label's electrical contact with the rail. The latter possibility illustrates that a rail system must provide not only mechanical integrity but electrical integrity. It is undesirable that a rail be susceptible to changes in shape that would reduce the electrical integrity of the label's connection thereto.

Yet another competing factor in system design is the requirement that the initial installation of the system be quick. Labor inputs for system installation call for relatively skilled technicians, whose time should be efficiently used. When the rails are attached to the shelves, fasteners such as screws are typically used. It is desirable that no more fasteners be used than are necessary to keep the rail reliably on the shelf. The system has to integrate itself gracefully with shelf mechanical configurations commonly used in stores, such as the standard "C" channels found at the outside (near) edge of most shelves in North America.

Another concern is that addition of rails to a store should not interfere with existing store functions. One obvious example is that if the rail has greater vertical extent than the "C" channel, it will make the shelf unusable for some products the tallness of which had barely permitted placement on the shelf before the rail was installed. Another example is that a store employee will sometimes restock goods by propping one edge of the corrugated cardboard case or carton against the "C" channel, holding the case in place by pressure applied by the abdomen to the other edge of the carton. This increases the stocking efficiency of the employee. During such so-called "belly stocking" both hands are free for lifting goods from the case onto the shelf. It would be undesirable if the rail to be installed to a shelf did not provide a face accommodating belly stocking.

Still another competing factor in system design is the requirement that additions and changes to the price display system be straightforward for authorized store personnel; despite this the system should actively discourage unauthorized tampering and modification. Since the display labels are nonzero in cost, it is desirable that the system function so as to minimize theft or other loss of the labels themselves.

Finally, system design must answer to aesthetic values. It is desirable that the rail itself be relatively unobtrusive, so that each label is all the more easily identified and located. If fasteners such as screws are used to secure the rails to the shelves, it would be preferable that the screw heads not be visible. Where a store has an intentional color scheme it would be desirable that the rail configuration permit style elements to conform to the color scheme.

From the foregoing discussion it will be appreciated that it is no easy task to optimize all the above-mentioned aspects of the design of a price display system. Yet to be commercially viable a price display system must offer at least a moderate degree of success on nearly every measure. As was mentioned above, the lack of commercial success in any of numerous attempted electronic price display systems is attributable at least in part to shortcomings in one or more of the above aspects.

SUMMARY OF THE INVENTION

An improved electronic price display system has rails into which are installed price display labels. A ridge along the top of the rail is shaped to receive the top of the label, and a ridge along the bottom of the rail is shaped to receive pawls at the bottom of the label. A removal tool may be engaged at a fulcrum point with the label, after which the tool is rotated and turned with a wrist motion to release the pawls, and is withdrawn to extract the label.

A hemicylindrical feature at the back of the rail permits generous area of contact with a mounting screw having a hemispherical head. Opposed groove features above and below the hemicylindrical feature permit sliding a plastic trim strip into the rail to conceal screw heads and to provide a visual design element. Ridges at the rear of the rail together with an optional resilient insert, permit quick mounting to a shelf with a minimal number of fasteners.

Angled ridges on the rear face of the label engage with mating angular ridges (also called knurls) on the rail so that as the label slides into place, the label moves slightly laterally along the rail. While the above described ridges are preferred, the term knurls is intended to encompass any texture or surface treatments intended to prevent sliding or lateral motion. This provides contact wiping as the label is installed, enhancing electrical integrity of the label-to-rail connection. The enmeshing ridges also fix the label in place lengthwise along the rail.

A feature along an edge of the rail provides a cylindrical concavity or channel surrounded for more than 180 degrees of circumference. Stated differently, the opening of the channel is less than 180 degrees. An optional clear plastic cover is mounted with a cylindrical edge bead in the channel, thereby providing a hinged connection therebetween. The other edge of the cover snaps into place by interference fit to a mating feature along the other edge of the rail. If the cover is flexible, an optional bead along the rear face of the cover lines up with a projecting button on the face of the label; pressing the cover in the vicinity of the button actuates the button.

It will be appreciated that although the embodiment shows the bead and cylindrical channel at the top of, the rail, they could just as well be positioned at the bottom, in which case the cover would open downwards rather than upwards.

A subassembly of the label provides a robust carrier for springy contacts providing electrical connection between the label and long conductors on the rail. The subassembly accomplishes reorientation of conductors for soldering to a printed circuit board, protecting the circuit board from stresses due to compression of the springy contacts.

DESCRIPTION OF THE DRAWING

The invention will be described with respect to a drawing, of which.

Like elements in the figures have been shown, where possible, with like reference designations.

DETAILED DESCRIPTION OF AN EXEMPLARY EMBODIMENT

Figure 1:
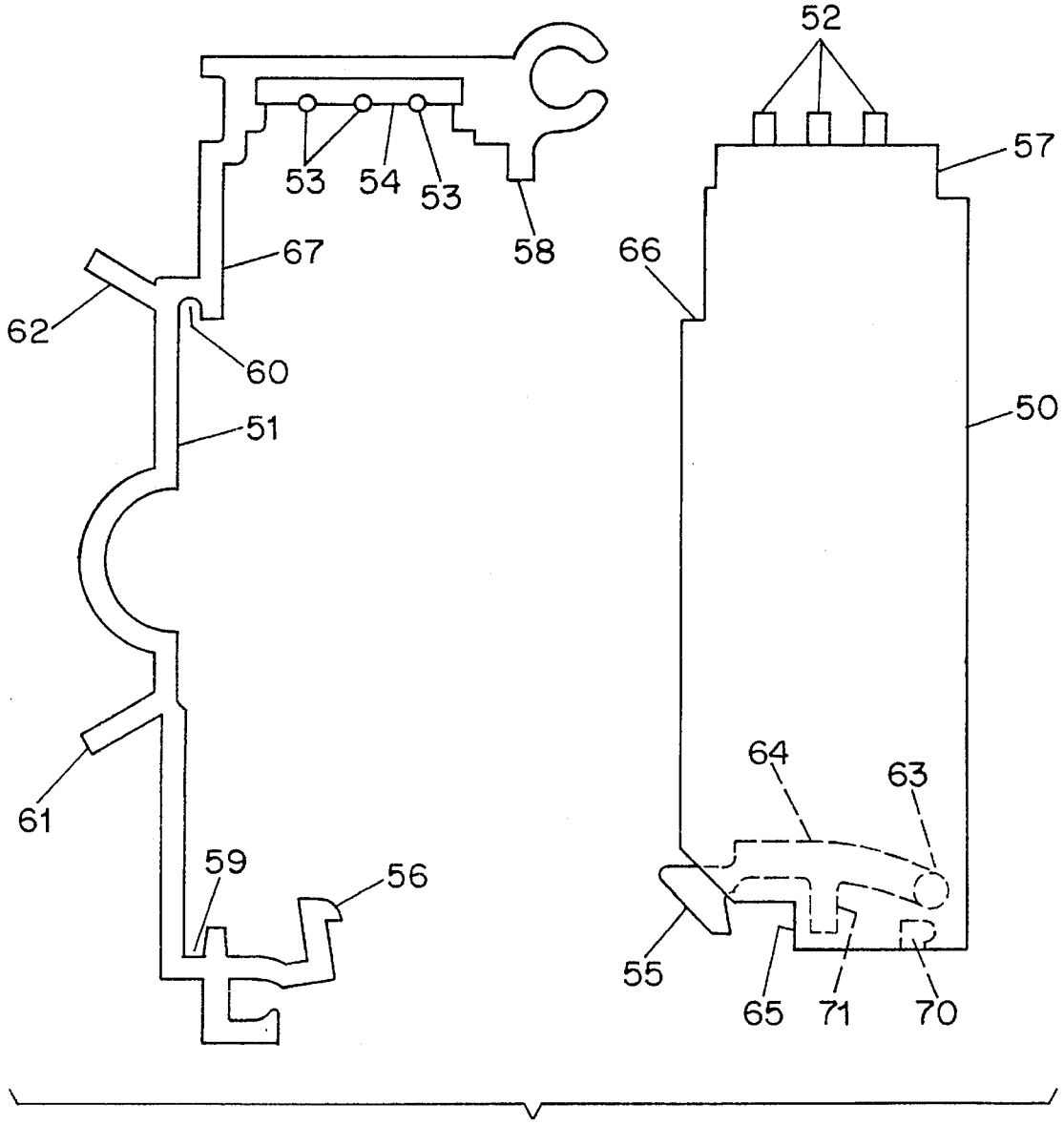
FIG. 1 is an end-view cross section of the rail and label.

Turning to FIG. 1, there is shown a rail 51 and a label 50, each in end view. Label 50 has a front (to the right in FIG. 1), a top with contacts 52 and feature 57, a bottom with pawl 55 and other features, and a back with feature 66. Feature 57 is variously called a slot or a cutaway, and runs the length of the label.

Label 50 in one of typically several tens of thousands of labels 50 in the system. The front of the label, not shown in FIG. 1, has an LCD display, an LED, and a pushbutton. A processor within the label connects with the contacts 52 and with the LCD display. Under control of the microprocessor information from the host is communicated via contacts 52 and displayed on the LCD display.

Label 50 has a pawl 55 on an end of arm 64 which pivots at 63. A concavity 70 has a mouth with an opening smaller in cross section than the interior of the concavity. A member 71 is formed as part of member 64, extending downward within label 50. Label 50 is preferably made of ABS plastic or other similar material.

The rail 51 has numerous features corresponding to those of the label 50. A bottom ledge of the rail extends from the back of the label to a ridge 56. Ridge 56 of the rail engages with pawl 55 of the label, and cutaway 65 of the label makes room for ridge 56. A top ledge of the rail extends from the back of the rail to a ridge 58. Ridge 58 of the rail engages with edge 57 of the label. Contact strip conductors 53, which run the length of rail 51, engage electrically with contacts 52. The conductors 53 of the rail are held in insulating strip 54. Cutaway 66 of the label accommodates region 67 of the rail, together with any features (not shown in FIG. 1 for clarity) as may optionally be formed thereon. Conductors 53 run along the length of the rail and provide not only electrical power but also data signals. Except as may be constrained by optional knurls as discussed below, the label 50 may be placed at any of a multitude of locations along the rail. Because the conductors 53 are continuous, a label 50 positioned at any of a multiplicity of points along conductors 53 is able to receive electric power and the data signals.

Rail 51 has grooves 60, 59, which as described below in connection with FIG. 13 permit a trim strip to be slipped into place. Ribs 61, 62 are sized and placed to fit within standard supermarket "C" channels as commonly found on the outside (near) edge of a supermarket shelf.

Figure 2:
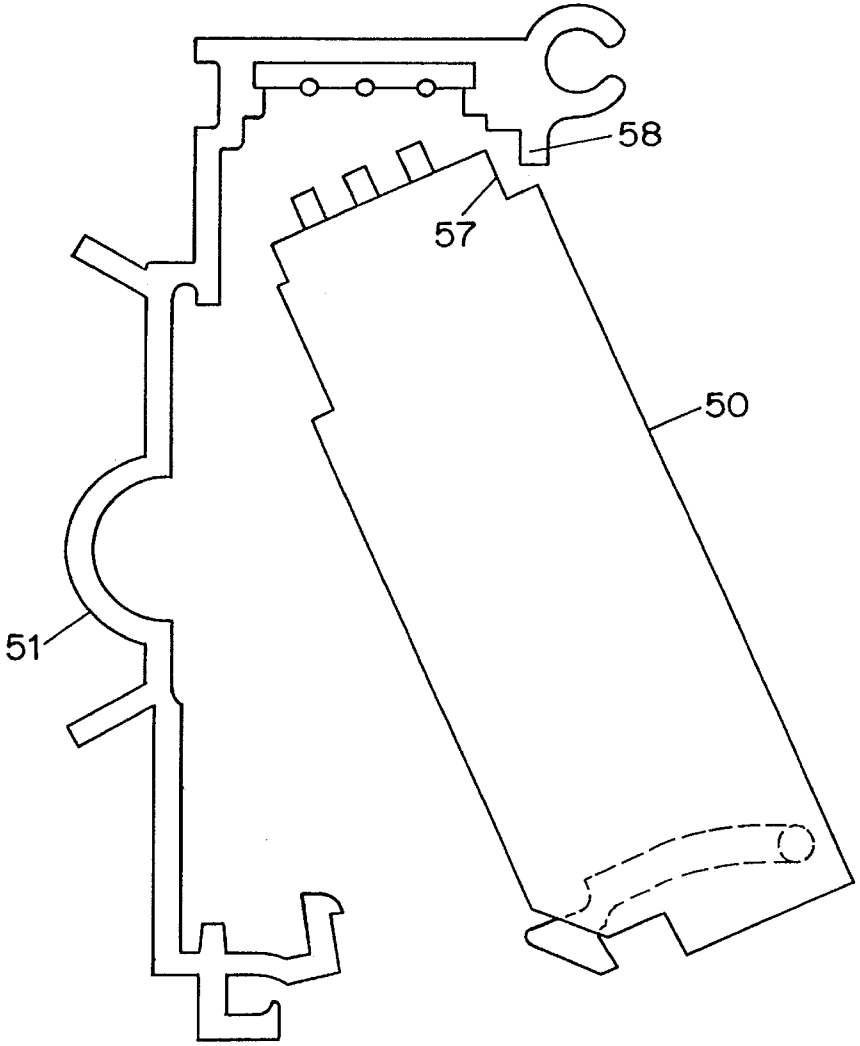

FIG. 1 shows a label that is not connected to a rail. The process of inserting a label 50 into a rail 51 will now be described. First, as shown in FIG. 2, the upper edge of the label 50 is guided gently up into the rail cavity. It is necessary that cutaway 57 end up behind ridge 58, and the technician performing such installations repeatedly will readily grow accustomed to guiding the label in this way. If a groove 57*a* (shown in FIG. 12*d*) is provided, the groove serves as an insertion guide.

Figure 3:
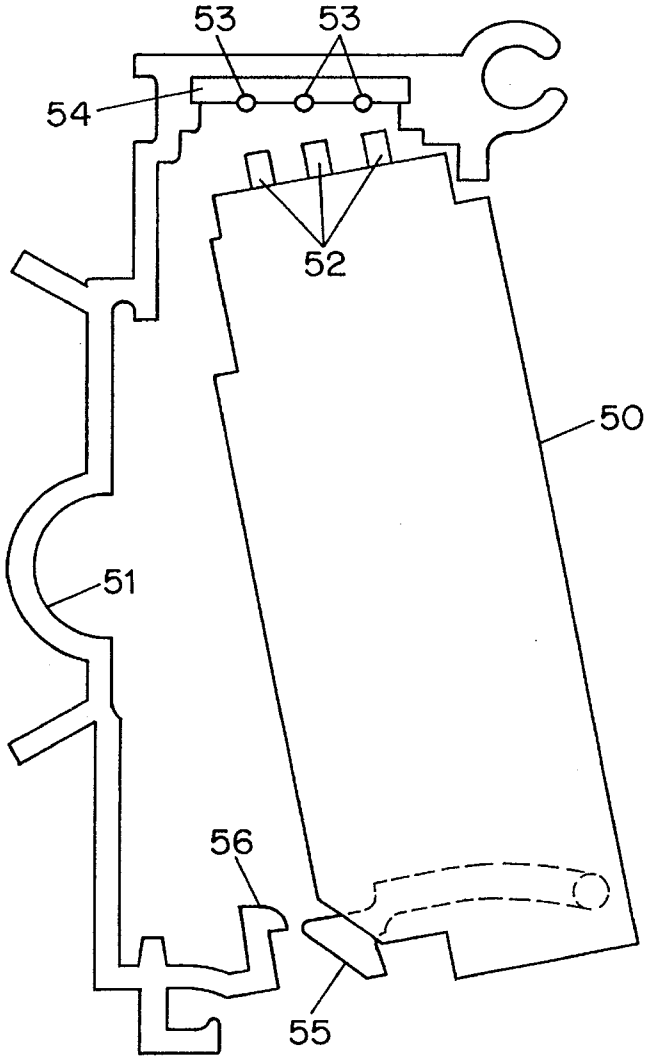
FIGS. 2, 3, 4, and 5 show in end view and in sequence the events occurring as a label is inserted into the rail.

In FIG. 3 the label is still a few degrees from the vertical, and contacts 52 are nearby to the contacts 53. Significantly, during the remainder of the insertion movement most of the relative motion of contacts 52 and 53 will be simply toward each other; contacts 52 will mostly be moving straight up with very little lateral movement (to the left or right in FIG. 3). This reduces the likelihood of unwanted lateral pressures on conductors 53, and reduces the likelihood that the conductors 53 would be dislodged from their positions as formed into insulator 54. As shown in FIG. 3, pawl 55 approaches ridge 56 but has not come into contact with it yet. Ridge 56 is radiused both to ease pawl 55 upward and to smooth movement of the body of label 50 past the ridge 56.

Figure 4:
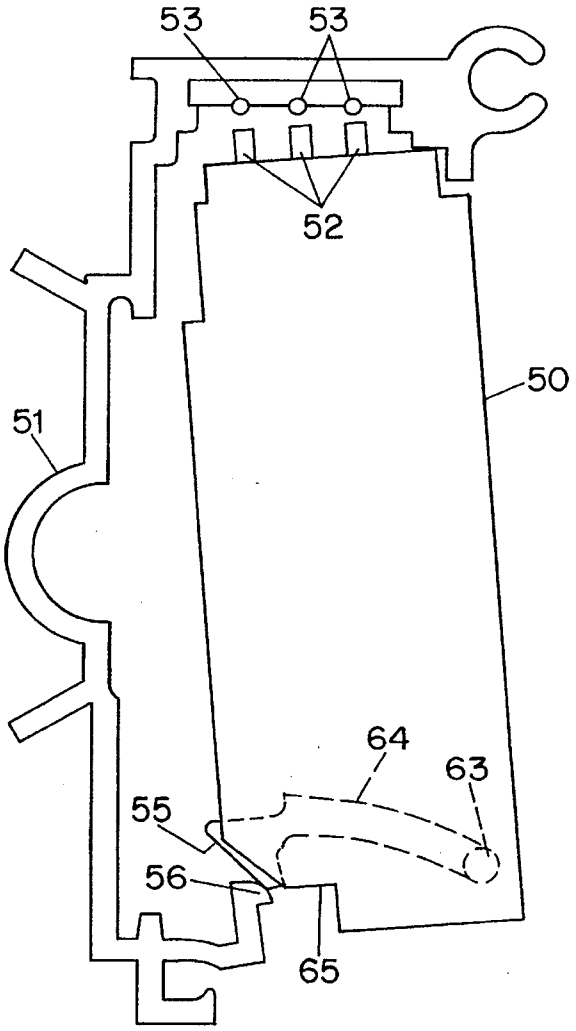

In FIG. 4 the label 50 is nearly into place in the rail 51. Pawl 55 has been lifted upwards so that it is almost completely within the body of label 50, which necessarily lifts arm 64 and rotates it about pivot 63. Such movement opposes a spring or other biasing means, not shown in FIG. 4, which would normally urge pawl 55 downwards in FIG. 4. It will be noted that the body of label 50 in the area of cutaway 65 is nearly in contact with ridge 56, and that contacts 52 are nearly in contact with conductors 53.

Figure 5:
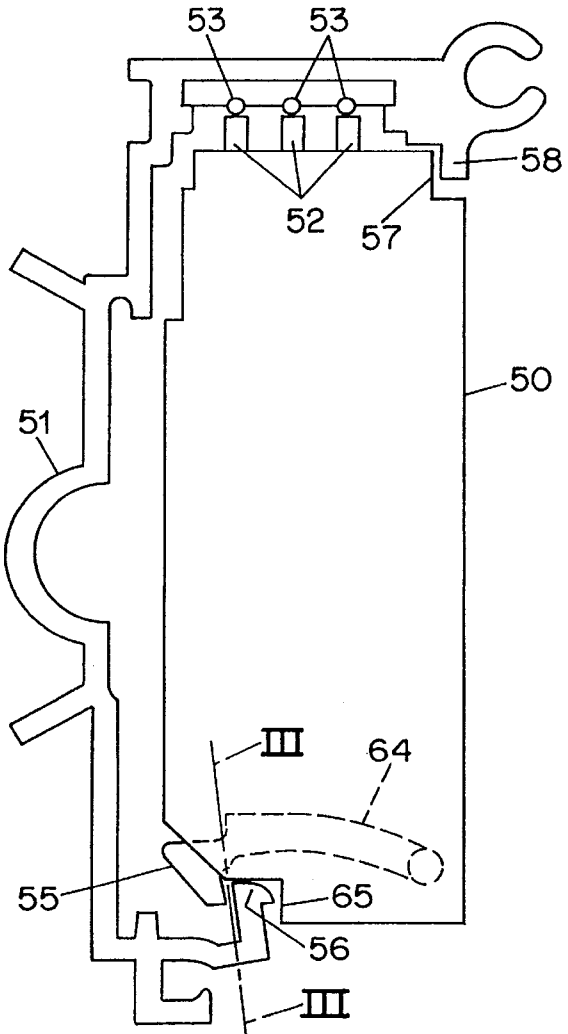

In FIG. 5 the label 50 has been snapped into place after a small leftward (clockwise) movement from the position shown in FIG. 4. Pawl 55 has dropped down behind (to the left of) ridge 56. It will be noted that the faces of contact of pawl 55 and ridge 56 are not vertical but are angled slightly backwards, falling into plane shown by a dashed line 111 in FIG. 5. This provides a more positive locking into place that would be achieved if the plane were vertical or, worse, angled forwards.

For clarity in FIG. 5 the label 50 is not shown as resting on ridge 56. In actuality the label does rest on the ridge 56, and provides a modest interference fit defined by the other point of contact, namely where ridge 58 and surrounding structure bear on cutaway 57 and surrounding structure. It will also be noted that the pawl is a rest (unstressed) position and thus is not subject to cold flow, cracking, or relaxation which could lead to failure.

It will be appreciated that the label of the invention is rotated about an axis running the length of the label as part of the insertion movement, and that the axis is coincident with the slot 57. This contrasts with other label designs such as that shown in the above-mentioned copending U.S. patent application Ser. No. 07/965,877, in which the label rotates, when inserted, about an axis perpendicular to the length of the rail.

It will also be appreciated that while the label and rail are described with the assumption that the pawls are at the bottom and that rotation of the label is with respect to an axis at the top of the rail, nothing in the invention mandates that choice. One could, without deviating in any way from the invention, invert this arrangement locating the pawls at the top with rotation about an axis at the bottom.

Figure 6:
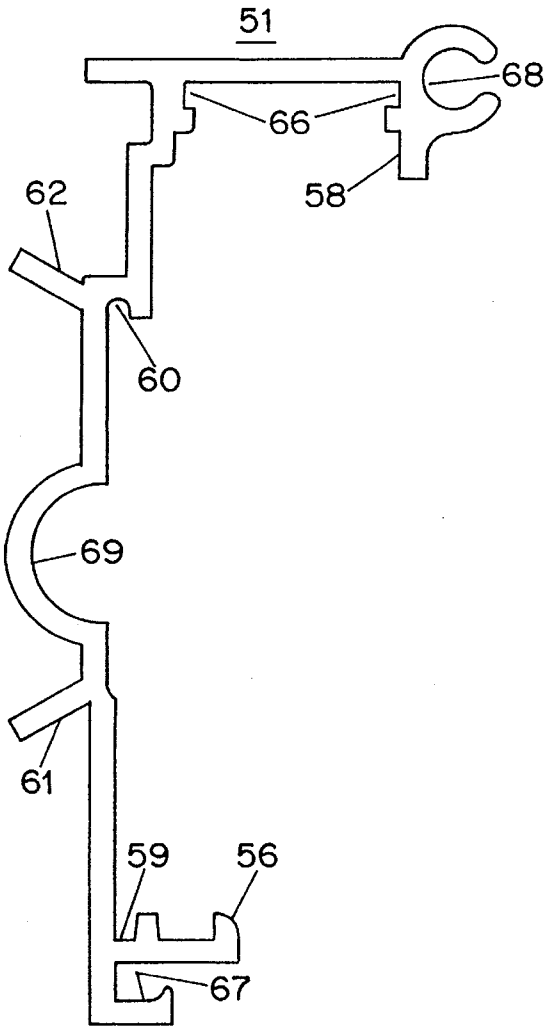
FIG. 6 shows the rail in end-view cross section in greater detail than FIG. 1.

FIG. 6 shows the rail 51 in end-view cross section in greater detail than FIG. 1. A hemicylindrical feature 69 is formed in the rail and extending, like the other features shown in FIG. 6, along the length of the rail, which is of substantially constant cross section. Ribs 61, 62 extend from the rear of the rail. Optional grooves 66 are formed so as to receive insulating substrate 54, not shown for clarity in FIG. 6. Alternatively, grooves 66 may be omitted and the top of the channel lowered accordingly to maintain mechanical spacing, with the substrate 54 held by an adhesive. Grooves 59, 60 are formed so as to receive a flexible trim strip. The grooves 59, 60 are spaced so as to approximate the spacing of a standard store "C" channel, so that shelf talkers and the like may be snapped into place in grooves 59, 60 as easily as they could have been snapped into place in the shelf's "C" channel had the rail 51 not been installed. (A "shelf talker" is a hook or sign extending into the store aisle, secured by springy clips into the "C" channel.) Groove 59 is an upwardly opening groove on the front of the rail 51, while groove 60 is a downwardly opening groove. Each extends substantially the length of the rail. It will be appreciated that the label 50 is mounted removably and in front of the grooves.

Rib 61 preferably extends at least partially downward so that it can better support the rail with respect to downward forces applied to said rail.

In an alternative embodiment, instead of hemicylindrical feature 69 there is provided a lengthwise extending trough having an apex and upper and lower walls. The trough opens on the front side of said rail, and is sized to accommodate substantially the head of a #6 size flat-head screw. Advantageously, a self-tapping screw can be screwed through the apex from the front side without the screw walking in the vertical direction. The flat-head screw, when screwed through the apex, is substantially countersunk within the trough. The trough is located vertically between upper and lower grooves 60 and 59, and the said grooves are located forward of the trough.

At 68 is a feature defining a cylindrical cavity. The rail is formed to surround slightly more than 180 degrees of the cylindrical cavity, that is, just over half a circle; the feature accommodates an optional swinging clear plastic cover. At 67 is a feature discussed below in connection with the plastic cover.

Rail 51 is preferably made of extruded aluminum but may also be fabricated of other material such as plastic or composite material. But for certain optional knurling features discussed below the rail is extruded with constant cross section and used without further shaping other than being cut to length.

Figure 7A:
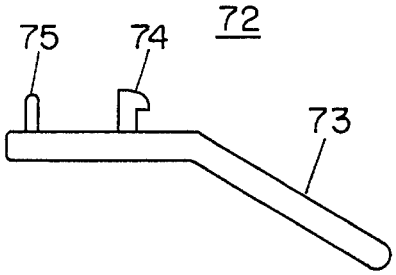
FIGS. 7*a*, 7*b*, and 7*c* are side, top, and perspective views of the removal (unlocking) tool permitting removal of the label from the rail.
Figure 7B:
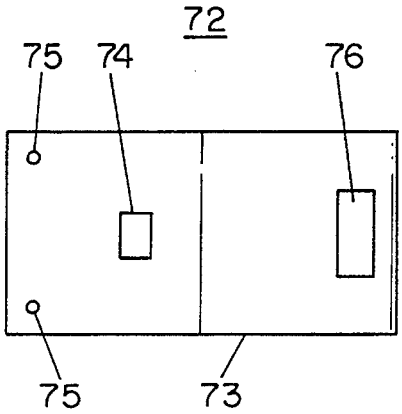
Figure 7C:
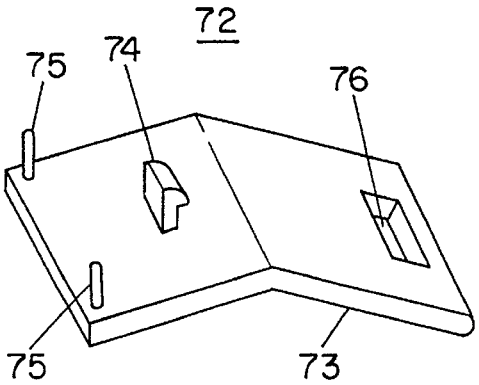

FIGS. 7*a*, 7*b*, and 7*c* are side, top, and perspective views of the removal (unlocking) tool 72 permitting removal of the label from the rail. The tool is formed with a protuberance 74, the protuberance having a neck smaller in cross section than the main body of the protuberance. The cross section of the main body of the protuberance 74 and the cross section of the mouth of opening 70 (shown in FIG. 1) are selected to provide an interference fit detent tending to hold the protuberance within the concavity. The tool clicks into place. The protuberance 74 and opening 70 define a fulcrum or pivot permitting rotation of the tool 72 relative to the label 50, and it will be appreciated that this movement is about an axis lying within the label 50 and parallel to the length of the rail 51. Fingers 75 are provided to correspond in number to the pawls 55 (shown in FIG. 1). When the handle 73 is moved downward in FIG. 7*a* (clockwise), then the finger moves the pawl 55 away from engagement with the ridge 56 (shown in FIG. 1). Hole 76 is provided so that tool 72 may be carried on a key chain or lanyard. The tool is preferably formed in the same molding process as is used to make the pieces of the body of label 50, and of the same thermosetting plastic such as the preferable ABS.

Figure 8:
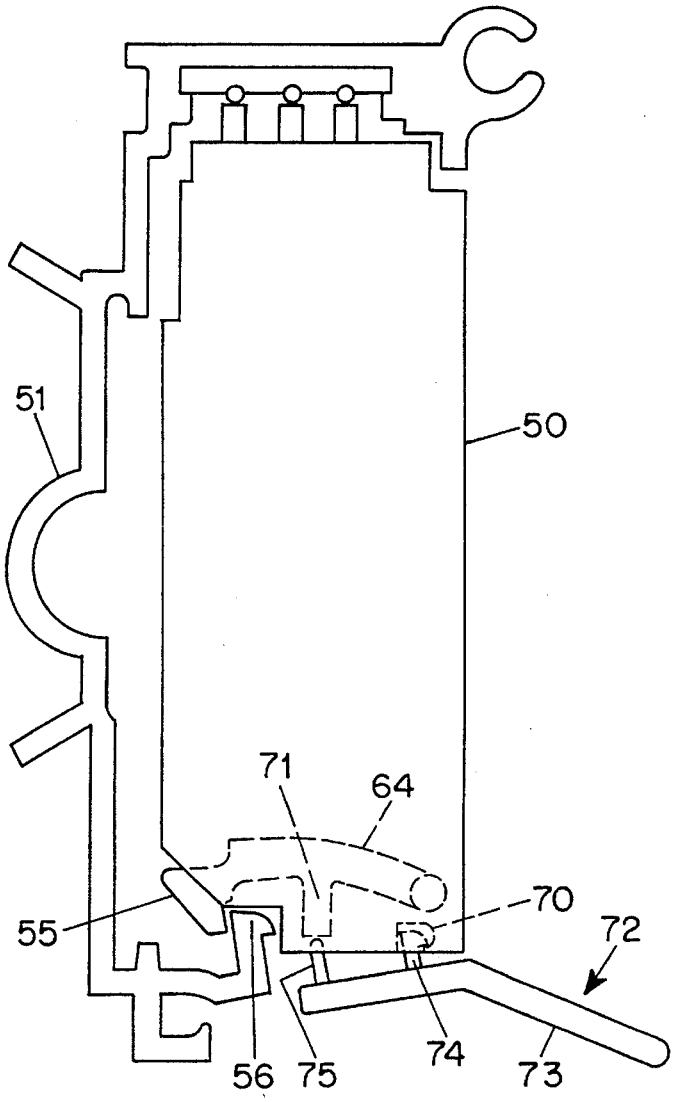
FIG. 8 shows in end view a rail and label with removal tool positioned for use.

FIG. 8 shows in end view a rail 51 and label 50 with removal tool 72 positioned for use. Protuberance 74 has been clicked into place into opening 70, defining the possible movement of tool 72 as clockwise about a pivot or fulcrum point inside the label 50. Finger 75 touches but does not yet displace member 71. In FIG. 8, pawl 55 continues to engage ridge 56, constraining label 50 from counterclockwise rotation.

Figure 9:
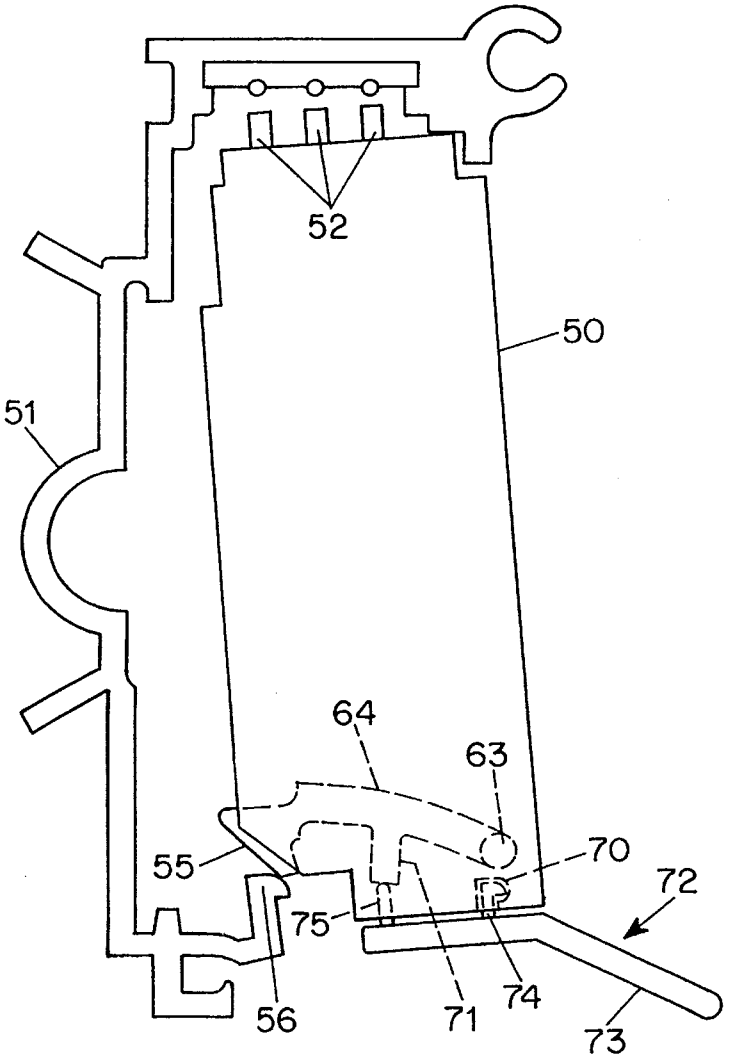

FIG. 9 shows the state of affairs after the handle 73 of tool 72 has been moved slightly downward and after the label 50 and tool 72 have both been moved slightly to the right. Finger 75 has moved member 71 upwards, rotating arm 64 clockwise about pivot 63. Pawl 55 has cleared ridge 56. Contacts 52 are springy, and to the extent that they affect the movement depicted here they affect it in the direction that helps—they tend to give a slight counterclockwise urging to the label 50.

Stresses are developed during unlocking that reach the design limits for the plastics used in the preferred embodiment; the stresses reaching the design limits are in and around the protuberance 74 and the fingers 75. Advantageously the design shown in FIG. 9 is such that if there is a structural failure it is likely to be in the removal tool 72 rather than in the label 50, namely in breakage of the protuberance 74 or a finger 75; if either breaks the debris, assisted by gravity, will fall away. This permits another removal tool to be used to remove the label, which is preferable to a failure mode in which the tool still works but the label cannot be removed.

Figure 10:
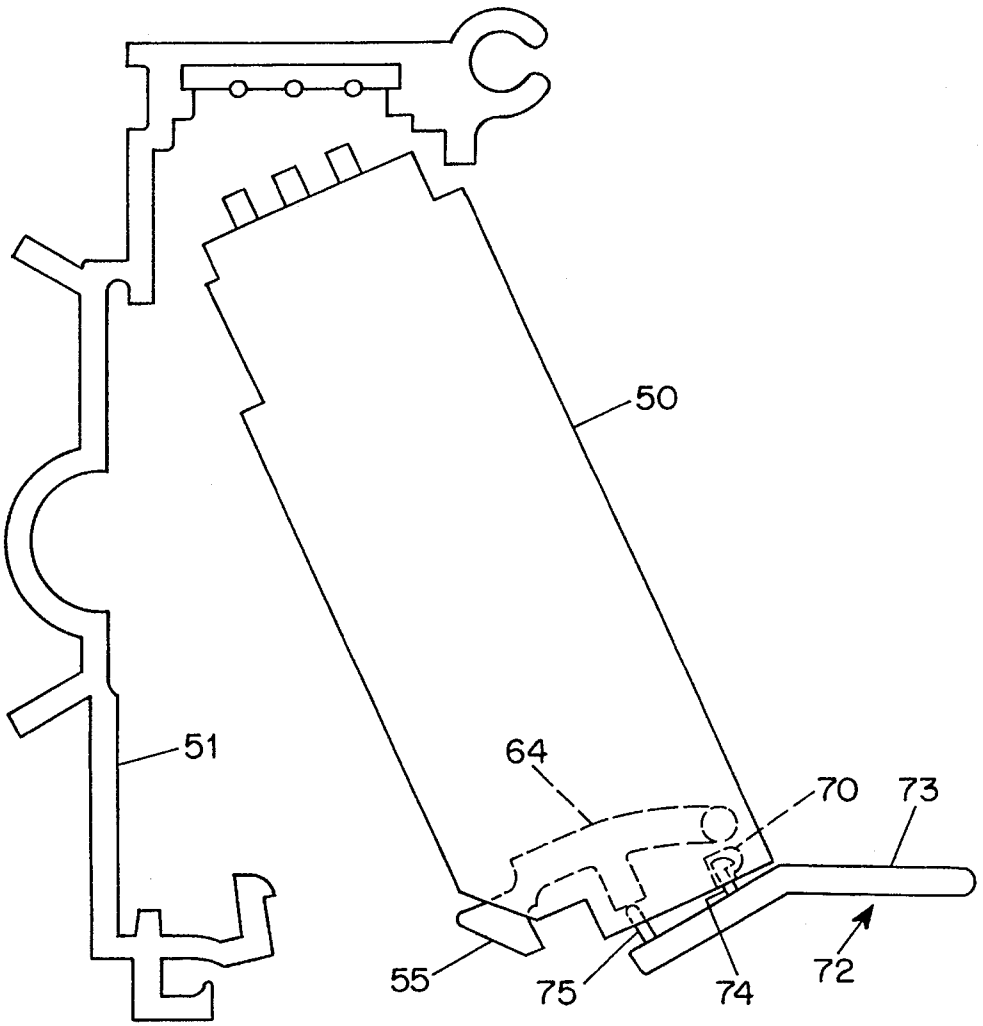
FIGS. 9 and 10 show in end view and in sequence the events occurring as a label is removed from the rail.

FIG. 10 shows in end view the label 50 after counterclockwise rotation from the position shown in FIG. 9. The user may have permitted the pawl 55 and arm 64 to return to their rest positions toward the bottom of label 50. The label 50 is free of the rail 51, and the removal tool 72 may be snapped loose from the label 50. The label 50 may be reinserted elsewhere along the length of the rail 51 shown in FIG. 10, or on a different rail 51 elsewhere in the store if desired.

Figure 11A:
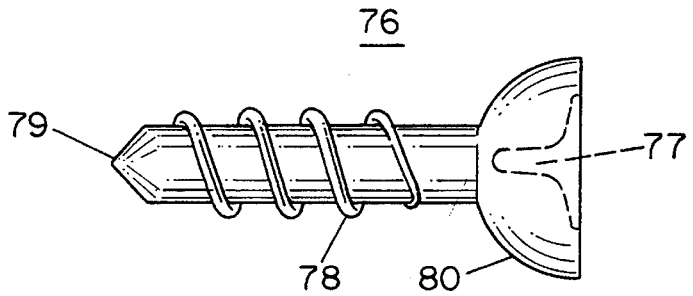
FIGS. 11*a* and 11*b* show side and top views of an improved screw for use with the rail.
Figure 11B:
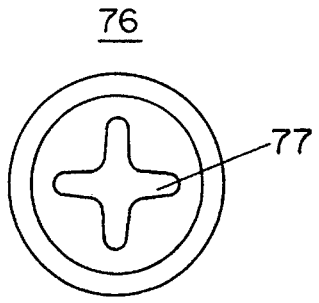

It will be recalled from the discussion above regarding FIG. 6 that a hemicylindrical feature 69 is formed into rail 51. This feature is the receiving point for a self-tapping screw, not shown in FIG. 6, which penetrates the rail 51 and the "C" channel of a shelf to secure the rail to the shelf. FIGS. 11*a* and 11*b* show side and top views of an improved self-tapping screw 76 for use with the rail. Screw 76 is self-tapping with a drill point 79 capable of drilling soft aluminum such as is used in the rail 51, and capable of drilling the sheet steel typically used in shelf "C" channels. Threads 78 are sharply pitched so as to reduce the number of turns required to seat the screw. This reduces the mechanical advantage given to the power drill used to drive the screw, which reduces the likelihood of stripping out the hole in the steel "C" channel. Phillips opening 77 may be used, as may a conventional slot, a square drive or Torx opening as desired.

Advantageously, as discussed further below in connection with FIG. 13, a hemispherical head 80 is selected with a defining radius substantially the same as the defining radius of the hemicylindrical feature 69 (shown in FIG. 6). The tip 79 is chosen to be self-drilling and self-tapping in aluminum and sheet steel. The screw is preferably composed of passivated steel.

FIGS. 12*a*, 12*b*, 12*c*, and 12*d* show top, rear, bottom, and side views of the label 50 in greater detail than in FIG. 1. In the top view of FIG. 12*a*, contacts 52 are shown, preferably three in number and running parallel to the length of the label 50. Cutaway 66 is seen, and optional ridges 82 are shown. In the rear view of FIG. 12*b*, pawls 55 appear near the bottom of the label and are preferably two in number. Optional ridges 82 may now be seen more plainly than in FIG. 12*a*, and are angled slightly (preferably 10 degrees) to the vertical.

Figure 12A:
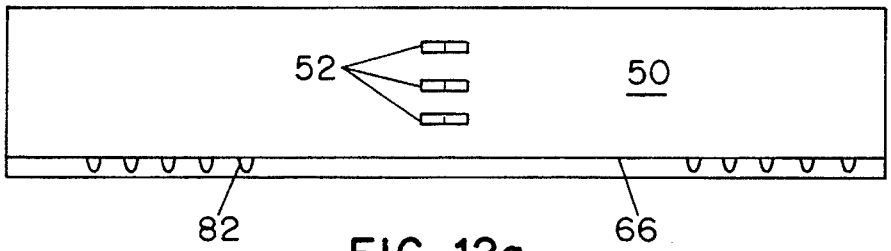
FIGS. 12*a*, 12*b*, 12*c*, and 12*d* show top, rear, bottom, and side views of the label.
Figure 12B:
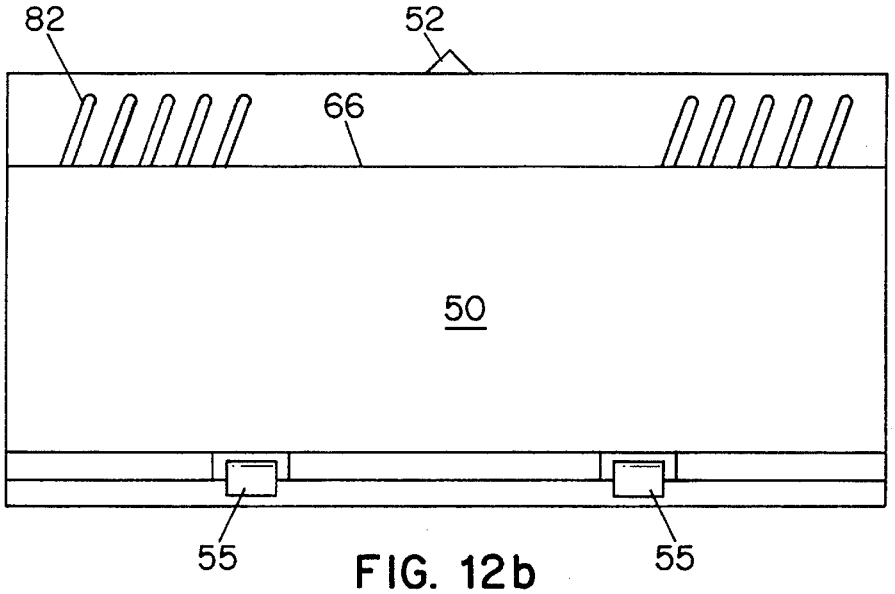
Figure 12D:
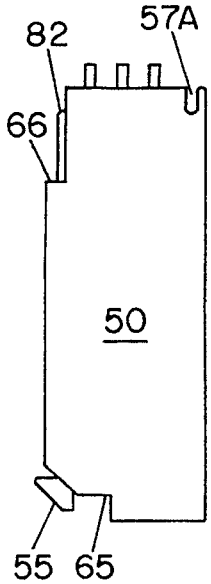
Figure 12C:
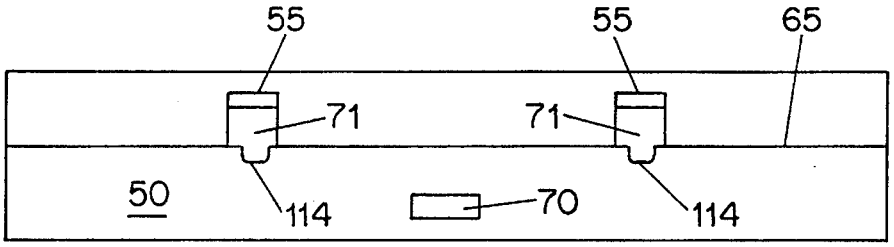

In the bottom view of FIG. 12*c*, pawls 55 are shown as is cutaway 65. Cavity 70 is also shown, having a more or less rectangular mouth. Cutouts 114 are provided so that fingers 75 (shown in FIG. 9) may reach members 71. In the side view of FIG. 12*d* the ridges 82 are visible in cutaway 66. FIG. 12*d* shows an alternative embodiment 57*a* for the cutaway corresponding to cutaway 57 as shown in FIG. 1. Embodiment 57*a* covers up more of the rail 51 and provides an insertion guide and a positive engagement. Pawl 55 is partially visible in cutaway 65.

The label 50 is shown with two pawls 55 and a single cavity 70. It will be appreciated, however, that without departing from the invention one could employ, say, one pawl and two cavities, or other combinations, so long as the tool 52 is constructed to correspond.

The label 50 is shown in FIGS. 12*a*, 12*b*, and 12*c* as being perhaps three times as long as it is tall. In actual practice a variety of labels are employed, of various widths depending on circumstances. A so-called "spice label" is provided with a width corresponding to product spacings with spice bottles and boxes. Other labels with two or more LCD panels are provided for items requiring more information than may be shown in a label with a single LCD panel. All the labels, however, despite differences in length, are intended to be installed and removed in the same way, and to have identical end-view cross sections so far as functional engagement with the rail is concerned.

Figure 13:
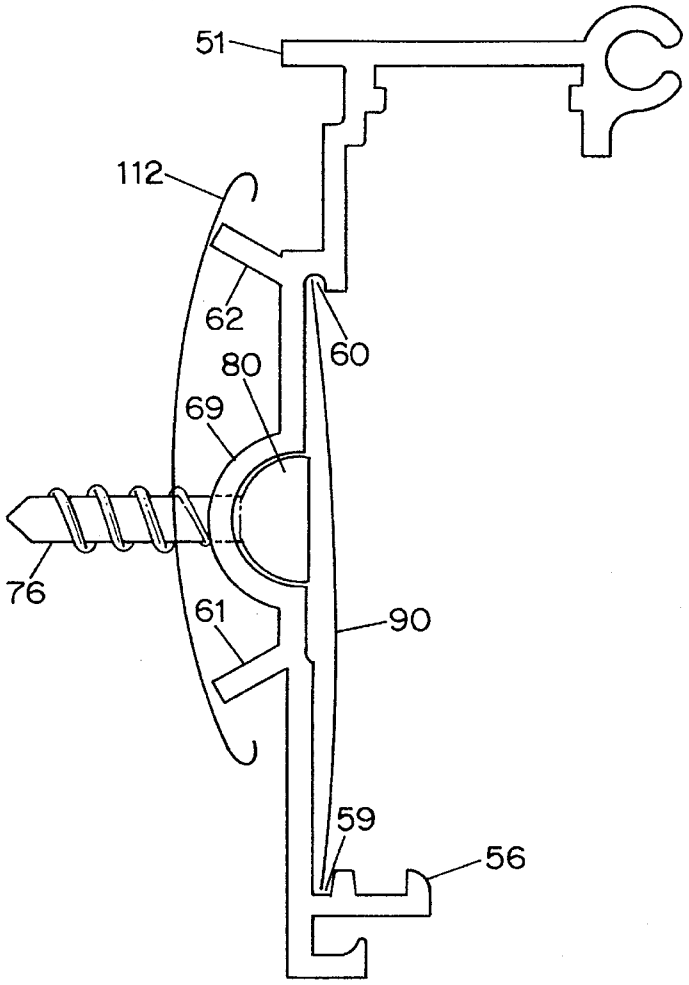
FIG. 13 shows in end view the rail with a screw in place and with a trim strip installed.

FIG. 13 shows in end view the rail 51 with a screw 76 in place and with a trim strip 90 installed. During the process of installing the rail 51 to the "C" channel 112 of a shelf (not shown for clarity in FIG. 13) the ridges 61, 62 were placed against the channel 112. The spacing of the ridges 61, 62 permits rotating and tilting the rail so optimize the viewing angle, which may differ depending on whether the shelf is at, eye level or above or below eye level. The ridges are preferably placed slightly closer together than ridges in standard supermarket "C" channel inserts. As a result, the rail can be pivoted to face partially upward or downward when the upper and lower ridges are placed in a standard supermarket "C" channel. The rearward extents of the ridges 61, 62 and the semi-cylindrical feature therebetween are chosen to be substantially coplanar. As a result, the rail seats firmly against a flat surface as some shelving systems exhibit.

When the angle is set, screw 76 is driven into the rail 51 and the "C" channel 112, securing the rail. In this arrangement two or more screws 76 are preferably used. Protrusion 69 is provided extending towards the rear in FIG. 13. The rearmost extend of the upper and lower ridges 61, 62, and of the protrusion 69 are all substantially coplanar.

Optionally, after the rail 51 has been secured with screws 76 a trim strip 90 may be put into place in grooves 59, 60. Such a trim strip conceals the mounting screws 76 and can play a part of the aesthetic design concept for the store. It will be appreciated that the strip could be colored or could carry patterns or printed indicia. The strip may be slid into the rail from the end or, if suitable squeezed, may be inserted from the front.

As was discussed above in connection with FIG. 5, it is intended that the label 50 be in a modest interference fit with ridges 58 and 56 of rail 51. It will be appreciated that deformation of the rail could affect this fit. The geometry of the three points of contact at the "C" channel, namely the screw 76 and the tips of ridges 61 and 62, is such that if the rail deforms due to overtightening of screw 76, the deformation is in the direction tending to tighten the interference fit. That deformation is much preferable to a deformation that would widen the rail opening instead. To accommodate the possibility of the interference fit being tighter due to overtightening of the screw 76, the ridge 56 is radiused to ease entry of the label into place. Also, the pawl 55 (shown in FIG. 4) and cutaway 65 are each beveled to ease movement past ridge 56 during insertion.

Figure 14:
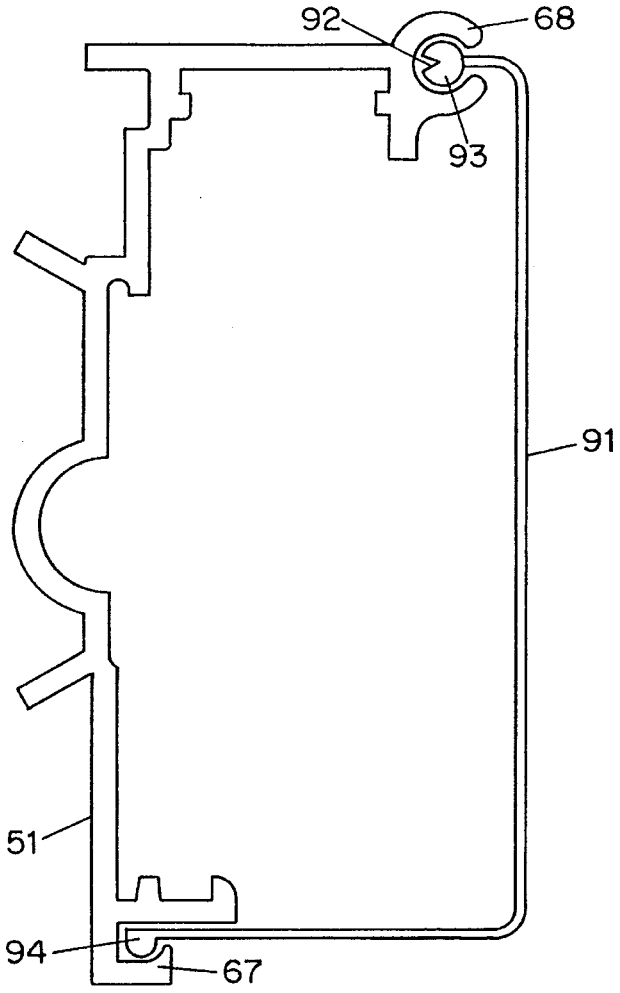
FIG. 14 shows in cross section the rail with a clear plastic cover.

FIG. 14 shows in cross section the rail 51 with a clear plastic cover 91. The cover 91 has a substantially cylindrical bead or feature 93 formed integrally therewith. The feature 93 is selected to fit smoothly into the cylindrical cavity at 68. The cover, which is preferably extruded with constant cross section, is generally equal in length to the rail 51 to which it is attached. A feature 94 snaps into place with feature 67 of rail 51, holding the cover neatly in place. This feature secures the plastic cover in the closed position. The cover protects the labels 50 from such hazards as shopping carts which might otherwise strike the labels 50, sliding the labels along the rail or knocking them loose. The cover provides substantially unhindered access to the labels when in an open position.

The bead 93 of cover 91 may preferably be slid into the cavity at 68 from one end of the rail. Depending on the plastic used and the desired range of movement of the hinge of bead 93 and the cavity, it is optionally possible to select the geometry of the cavity at 68 so that a pie-slice-shaped cutout 92 which preferably extends beyond the center of the cylinder permits frontal insertion of the cover 91 onto the rail 51. The cover 91 is shown with a flat front face, but other cross sections may be used.

Figure 15:
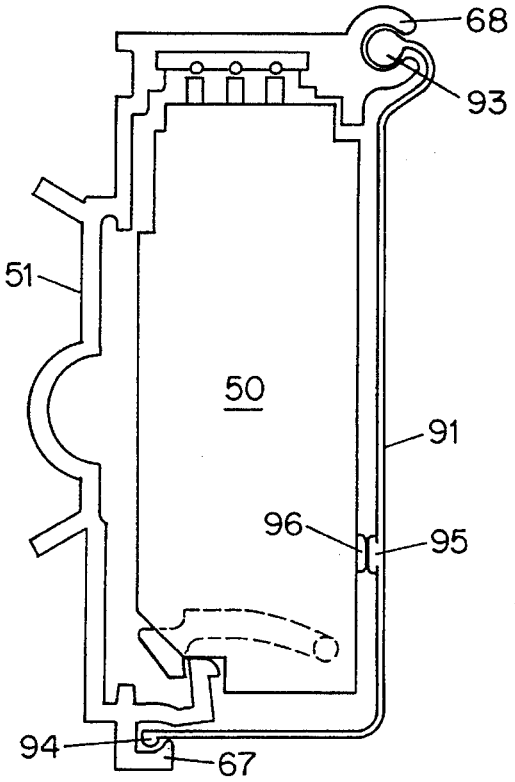
FIG. 15 shows in cross section the rail with a clear plastic cover and the ridge engaging a button on the face of the label.

In some embodiments the label 50 has a button 96 one the front (shown at FIG. 15). By button it is means any device or means actuable by a user. The button may permit the customer to send a signal to the processor of the label 50 so that the processor may send a message to the central processor. It might be thought that the cover 91 would prevent use of the button 96, but a ridge 95 may optionally be formed on the rear face of cover 91. With cover 91 fabricated from a relatively flexible plastic, then pressing the cover 91 anywhere near button 96 will transmit pressure to the button 96, actuating it. It will be appreciated that the pressure may be applied above, below, or to the left or right of the button to achieve this result. FIG. 15 shows in, cross section the rail 51 with a clear plastic cover 91 and the ridge 95 in contact with a button 96 on the face of the label 50. FIG. 15 shows one of many cover cross-sections which could be used, differing from that shown in FIG. 14 not only in provision of ridge 95 but also in the shape of the cover near bead 93. It will be noted that bead 93 in FIG. 15 has no pie-shaped cutout, so is intended for insertion into rail 51 from the end. In an alternative embodiment the ridge 95 may be omitted providing the bump feature is added to the button 96 so that it protrudes. With a suitable compliant material selected for the cover, the button may be activated through the cover.

It will also be appreciated that if the button 96 is to be pressed, it is possible simply to flip up the cover 91 to gain access to the button 96, regardless of whether ridge 95 is provided and regardless of whether button 96 protrudes or is flush with the face of the label 50.

Figure 16:
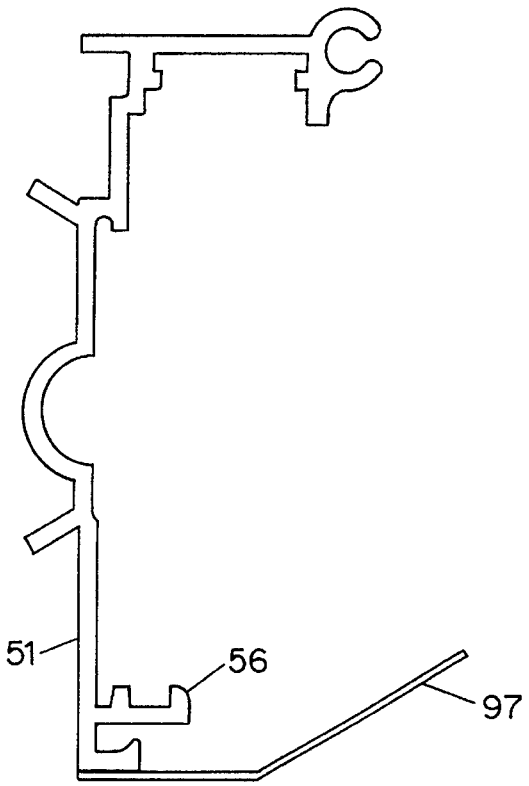
FIG. 16 shows in cross section the rail with a belly stocking ledge protruding therefrom.

FIG. 16 shows in cross section the rail 51 with a ledge 97 formed thereon. Its purpose is to facilitate "belly stocking" discussed above A store employee may prop the corrugated cardboard case against the "C" channel, holding the case in place by pressure applied by the abdomen. Thereafter, both hands are free for lifting goods from the case onto the shelf.

It will be appreciated that if cover 91 is not used, then ridge 56 may also be used as a support for belly stocking, at least in portions of rail where no labels 50 have been installed.

Figure 17:
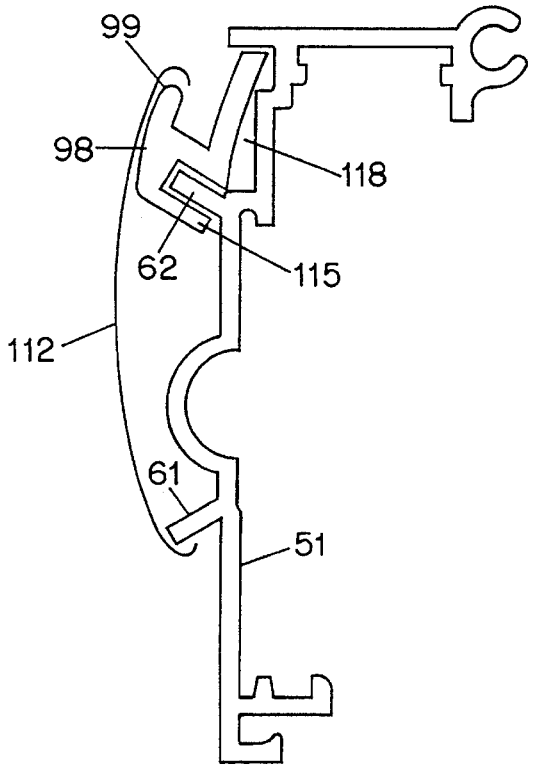
FIG. 17 shows in cross section the rail with a resilient insert facilitating snap-in mounting to a "C" channel of a shelf.

FIG. 17 shows in cross section the rail 51 with a resilient insert 98 facilitating snap-in mounting to a "C" channel of a shelf. Insert 98 is shaped to fit closely with rib 62 so that the insert 98 and rib 61 snap into place on a "C" channel 112. The insert 98 may extend the full length of the rail 51 or may not. The features at and above rib 62 define a channel means 118 into which the resilient insert is inserted. Tip 99 and rib 61 preferably mate to the "C" channel with spacing comparable to that of a shelf talker.

The fit into the channel 112 is quite strong, due to its extent along portions of rail 51 and channel 112. A single screw 76 (omitted for clarity in FIG. 17) suffices to secure the rail 51. This saves time during installation since only one fastener need be drilled, as compared with two or more fasteners if resilient insert 98 is not used. It will also be appreciated that an installer will preferably be provided with several shaped inserts 98 optimized for each of the shelf heights to which rails will be installed, to optimize viewing angle. Depending on the configuration, member 115 could be omitted, for example, and the entire insert could be above rib 62.

It will also be appreciated that the insert 98 could be shaped to fit instead with rib 61, for example for rails that are to be installed to low shelves. In this case features of rib 61 and of the rail below rib 61 would be formed to define channel means corresponding to channel means 118.

Finally, it will also be appreciated that the insert 98 may be tailored differently to suit different standard "C" channels.

Figure 18:
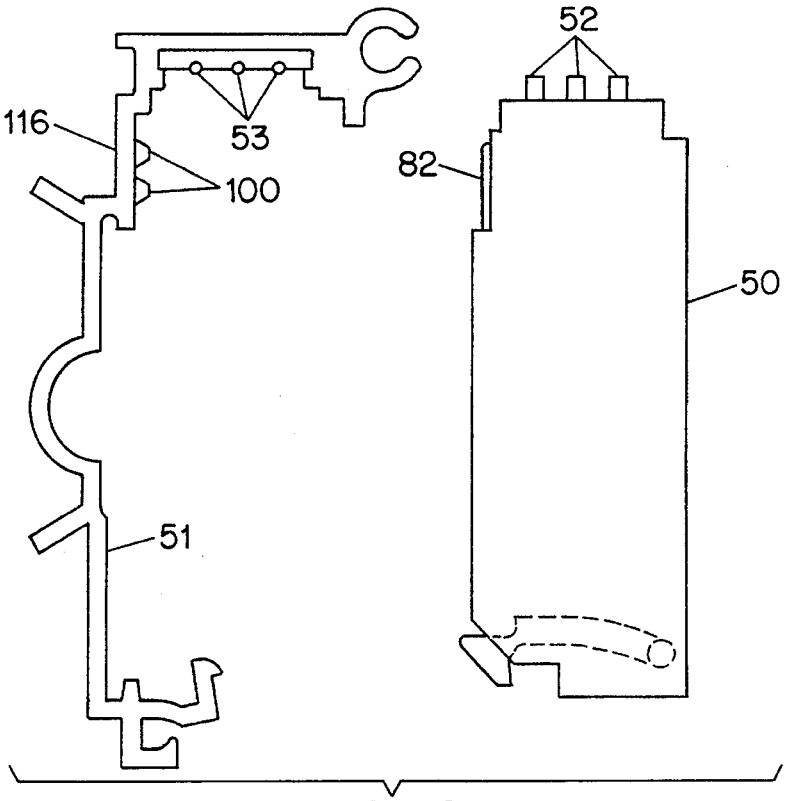
FIG. 18 shows in end view the rail and label depicting details of the angled ridges providing contact wiping.

FIG. 18 shows in end view the rail 51 and label 50 depicting details of the angled ridges 82. One or more rows of knurls 100 are optionally provided along rail 51, shaped to mesh with optional ridges 82. Because ridges 82 are angled slightly relatively to the vertical (preferably 10 degrees) then the label, when it snaps into place on the rail, moves slightly along the length of the rail. This provides a measure of contact wiping between contacts 52 and conductors 53, enhancing the reliability of the electrical connection therebetween. The meshing also serves to protect against unwanted sliding of the label along the rail due, for example, to a blow from an errant shopping cart. The contact wiping and lengthwise fixation of the label are preferably provided by either one or two knurled areas 100.

The knurls 100, if present, represent one of only a few features of the rail not accomplished by the extrusion. Stated differently, the knurls are one of the only features keeping the rail from being completely constant in cross section. Preferably, the knurls have their origins in ridges formed in the rail when it is initially extruded, stamped, or rolled. A knurling tool is later rolled along the rail to deform or cold-flow the aluminum into the knurled pattern. Preferably a flat anvil area 116 is provided at the rear of the rail to provide a bearing surface to oppose the pressure of the knurling tool. Preferably too the ridge and knurling tool are shaped so that no metal need be removed to provide the knurls; all the shaping is mere displacement of metal accomplished by pressing. Also, preferably features nearby to the ridge provide a guide for the knurling tool; such features may include ridges, grooves, or corners. If two knurl lines 100 are provided, the knurls are angled to match the angle of the ridges 82.

Another way in which sidewards movement may be prevented is by the provision, at the rear of the label 50, of a pressure pad. The pad is of rubber or other suitable compliant material. The pad, not shown in FIG. 12*b*, is located above feature 66, for example in the area where optional ridges 82 are shown. The pad is preferably held in place by an adhesive selected for adhesion to the material from which the label 50 is made, such as ABS. When the label 50 is in place in a rail 51, the pad presses against region 67 (shown in FIG. 1). The coefficient of friction of the pad and the geometry of the label 50 and rail 51 are selected to stop sideways movement of the label. Copending application Ser. No. 07/965,877 also treats the problem of unintended sidewards movement of the label, but the manner described herein in which labels are fixed from unintended sidewards movement thus differs from that shown in the copending application.

Figure 19:
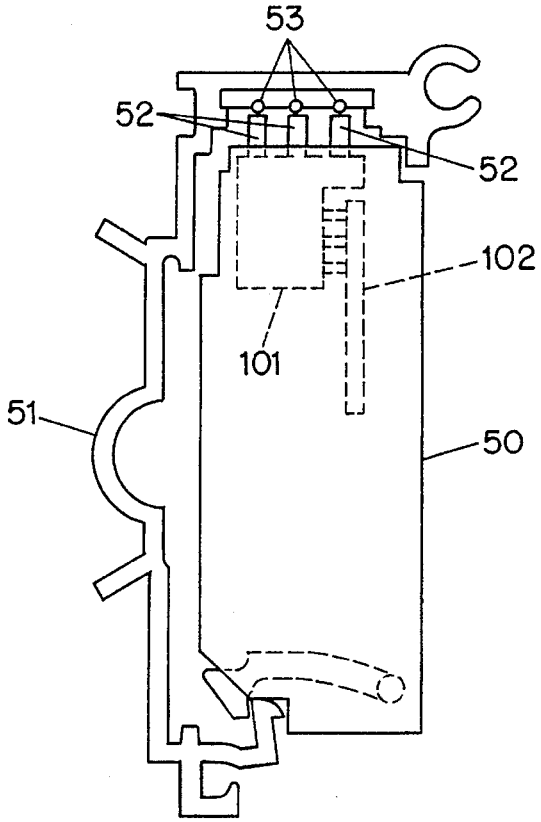
FIG. 19 shows in end view a rail and label, and depicts in phantom the springy connectors of the label and the printed circuit board connected thereto.

FIG. 19 shows the springy contacts 52, which to achieve a reliable electrical connection with the conductors 53 must be under some considerable constant compressive tension. FIG. 19 also shows in phantom the printed circuit board 102 of the label 50. The board 102 carries the microprocessor of the label (not shown for clarity) and other components.

Those skilled in the art will appreciate that if the compressive forces on the springy contacts 52 were to be imposed on the circuit board 102, there is a likelihood that the label will fail electrically. Likewise, if the repeated flexing due to label insertion and removal were to be transmitted to the board 102, failure would be likely. Failure modes include failure of a solder joint, breakage of a circuit board trace, and degradation of a feed-through at the solder joint.

It will also be appreciated that a reorientation of conductors has to be accomplished between contacts 52 and board 102. The contacts 52 have points of contact defining a line running from left to right in FIG. 19, which line is perpendicular to the length of the rail 51. The circuit board 102 defines a plane which does not, however, contain the above-mentioned line.

One approach to such a required reorientation is to use a flexible cable between the two regions. A cable has drawbacks, however—it takes time to assemble at the time of manufacture, and represents a number of electrical connections each of which has a nonzero likelihood of failure. The cable also does nothing to resolve the disposition of forces developed at the contacts 52.

Preferably an assembly 101, shown in phantom in FIG. 19, permits all the forces on contacts 52 to pass through to the body of the label 50 rather than to the circuit board 102. The assembly 101 also brings about the required reorientation of conductors.

Figure 20A:
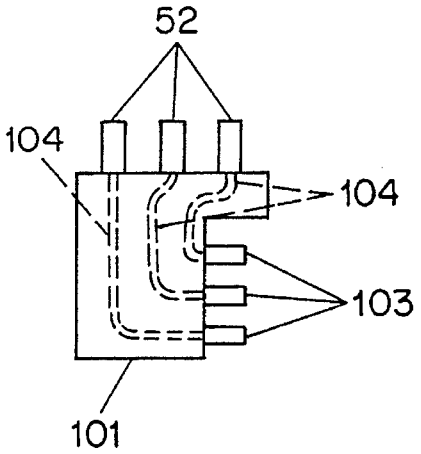
FIGS. 20*a* and 20*b* show side and front views of the connector assembly of the label.

FIG. 20*a* shows a side view of the connector assembly 101. Springy contacts 52 are at the top. Solderable contacts 103 appear at the right side. Interconnects 104, shown in phantom in FIG. 20*a*, provide electrical interconnection between respective springy contacts 52 and solderable contacts 103. The main body of assembly 101 is insulating, preferably made of high-density nylon. Preferably each contact 52 together with its corresponding interconnect 104 and solderable contact 103, are all three formed from a single unitary piece of metal.

Figure 20B:
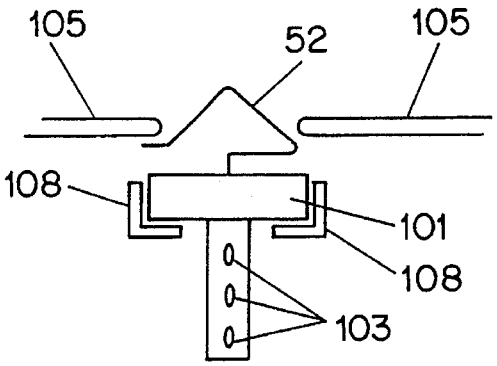

FIG. 20*b* shows a front view of the connector assembly 101. The frontmost springy contact 52 is visible, extending upwards to protrude above surface 105 at the top of the label. (Surface 105 defines slots through which contacts 52 protrude.) Solderable contacts 103 extend out of the page, with the circuit board 102 omitted for clarity from FIG. 20*b*. The main body of assembly 101 is shaped to fit securely into a cutout in the printed circuit board 102 and into features 108 molded into the body of the label. The secure fit ensures that forces and flexing at the contacts 52 pass to the body of the connector and to the cutout of the printed circuit board and not to the solder pads of the circuit board 102.

Figure 20C:
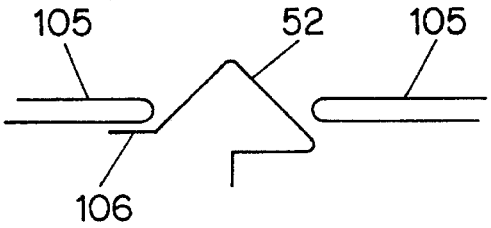
FIGS. 20*c* and 20*d* show in close-up front and perspective views a springy contact of the connector assembly.
Figure 20D:
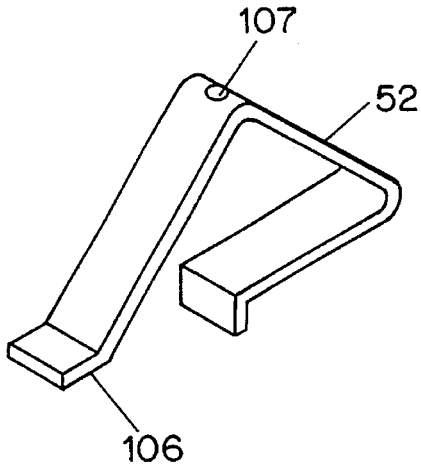

FIG. 20*c* shows contact 52 in close-up front view. End 106 is shaped to be confined below the surface 105. This keeps end 106 from snagging on things outside the label 50. FIG. 20*d* shows in close-up perspective view the springy contact 52 of the connector assembly 101. Bump 107 is preferably formed in contact 52 during the stamping process of fabrication. The bump helps to break any oxide barrier on contact 52 or conductor 53 when the two are placed in contact.

It will be appreciated that the protruding portions of the springy contacts 52 are disposed substantially parallel to each other, that the protruding portions of the solderable contacts 103 are disposed substantially in a line, that the points of contact of the springy contacts 52 can be said to define a first line, that the solderable points of the solderable contacts 103 can be said to define a second line, that the first and second lines intersect, and that the intersection of the first and second lines is substantially a right angle. In this way a simple, robust, reliable assembly provides the angle transitions required to interface between the conductors 53 and the circuit board 102.

Those skilled in the art will have no difficulty devising variations upon the particular embodiments set forth herein, all of which are intended to be encompassed by the claims.

We claim:

1. A system for removably mounting electronic price labels to an edge of a horizontally extending shelf comprising:

a rail having a back side for mounting against said edge, a front side for mounting said electronic price labels, a top, a bottom and two ends, said rail being of substantially constant cross section when viewed endwise, said rail defining an upward opening groove on said front side, said upward opening groove extending substantially from end to end, said rail further defining a downward opening groove on said front side, said downward opening groove being located above said upward opening groove, whereby a flexible insert can be held in place by said grooves;

means in front of said grooves for removably mounting an electronic price label; and means for supplying electric power and signals along the length of said rail whereby an electronic price label mounted to said rail at any of a multiplicity of points can receive electric power and signals;

further comprising a plastic cover having inside and outside faces, said cover being pivotally coupled along a horizontal axis to said rail, said cover being sized and placed so that it closely covers electronic price labels removably mounted to said rail when in a closed position and provides substantially unhindered access to said labels when in an open position;

wherein said plastic cover is flexible and further comprises a lengthwise extending ridge projecting from said inside face of said plastic cover whereby pressing inwards on said plastic cover when it is in a closed position causes said ridge to engage and activate a button on an electronic price label if located under an area being pressed.

2. A system for removably mounting electronic price labels to an edge of a horizontally extending shelf comprising:

a rail having a back side for mounting against said edge, a front side for mounting said electronic price labels, a top, a bottom and two ends, said rail being of substantially constant cross section when viewed endwise, said rail defining an upward opening groove on said front side, said upward opening groove extending substantially from end to end, said rail further defining a downward opening groove on said front side, said downward opening groove being located above said upward opening groove, whereby a flexible insert can be held in place by said grooves;

means in front of said grooves for removably mounting an electronic price label; and means for supplying electric power and signals along the length of said rail whereby an electronic price label mounted to said rail at any of a multiplicity of points can receive electric power and signals;

further comprising a plastic cover having inside and outside faces, said cover being pivotally coupled along a horizontal axis to said rail, said cover being sized and placed so that it closely covers electronic price labels removably mounted to said rail when in a closed position and provides substantially unhindered access to said labels when in an open position;

wherein said plastic cover is flexible, whereby pressing inwards on said plastic cover when it is in a closed position activates a protruding button on an electronic price label if located under an area being pressed.

3. A system for removably mounting electronic price labels to an edge of a horizontally extending shelf comprising:

a rail having a back side for mounting against said edge, a front side for mounting said electronic price labels, a top, a bottom and two ends, said rail being of substantially constant cross section when viewed endwise, said rail defining an upward opening groove on said front side, said upward opening groove extending substantially from end to end, said rail further defining a downward opening groove on said front side, said downward opening groove being located above said upward opening groove, whereby a flexible insert can be held in place by said grooves;

means in front of said grooves for removably mounting an electronic price label; and means for supplying electric power and signals along the length of said rail whereby an electronic price label mounted to said rail at any of a multiplicity of points can receive electric power and signals;

further comprising a plastic cover having inside and outside faces, said cover being pivotally coupled along a horizontal axis to said rail, said cover being sized and placed so that it closely covers electronic price labels removably mounted to said rail when in a closed position and provides substantially unhindered access to said labels when in an open position;

wherein said rail defines a lengthwise extending cylindrically shaped open channel extending along the bottom of said rail, said channel being open on said front side of said rail, said opening being open less than 180°, said plastic cover further comprising a substantially cylindrically shaped bead, said cylindrically shaped bead being sized to be pivotally held within said cylindrically shaped open channel, said cylindrically shaped bead being pivotally held by said cylindrically shaped open channel.

4. The system of claim 3 wherein said cylindrically shaped bead defines a substantially pie-slice shaped groove along its length whereby said cylindrically shaped bead can be compressed to fit through said opening into said cylindrically shaped open channel.

5. A system for removably mounting electronic price labels to an edge of a horizontally extending shelf comprising:

a rail having a back side for mounting against said edge, a front side for mounting said electronic price labels, a top, a bottom and two ends, said rail being of substantially constant cross section when viewed endwise, said rail defining an upward opening groove on said front side, said upward opening groove extending substantially from end to end, said rail further defining a downward opening groove on said front side, said downward opening groove being located above said upward opening groove, whereby a flexible insert can be held in place by said grooves;

means in front of said grooves for removably mounting an electronic price label; and means for supplying electric power and signals along the length of said rail whereby an electronic price label mounted to said rail at any of a multiplicity of points can receive electric power and signals;

further comprising a plastic cover having inside and outside faces, said cover being pivotally coupled along a horizontal axis to said rail, said cover being sized and placed so that it closely covers electronic price labels removably mounted to said rail when in a closed position and provides substantially unhindered access to said labels when in an open position;

wherein said rail has a lengthwise extending concavely curved upper surface and said plastic cover has a cylindrically shaped upper edge and wherein said cylindrically shaped upper edge is pivotally coupled with said concavely curved upper surface.

6. A system for removably mounting electronic price labels to an edge of a horizontally extending shelf comprising:

a rail having a back side for mounting against said edge, a front side for mounting said electronic price labels, a top, a bottom and two ends, said rail being of substantially constant cross section when viewed endwise, said rail defining an upward opening groove on said front side, said upward opening groove extending substantially from end to end, said rail further defining a downward opening groove on said front side, said downward opening groove being located above said upward opening groove, whereby a flexible insert can be held in place by said grooves;

means in front of said grooves for removably mounting an electronic price label; and means for supplying electric power and signals along the length of said rail whereby an electronic price label mounted to said rail at any of a multiplicity of points can receive electric power and signals;

wherein said rail further defines a lengthwise extending trough having an apex and upper and lower walls, said trough opening on said front side of said rail, said trough sized to accommodate substantially the head of screw whereby self tapping screws can be screwed through said apex from said front side without said screw walking in the vertical direction and whereby screws screwed through said apex can be substantially countersunk within said trough.

7. The system of claim 6 wherein said trough is located vertically between said upper and lower grooves and wherein said grooves are located forward of said trough.

8. A system for removably mounting electronic price labels to an edge of a horizontally extending shelf comprising:

a rail having a back side for mounting against said edge, a front side for mounting said electronic price labels, a top, a bottom and two ends, said rail having a top ledge extending outward from said top and a bottom ledge extending outward from the bottom, said top ledge having a ridge projecting downward and said bottom ledge having a ridge projecting upward, said rail being of substantially constant cross section when viewed from end to end; and means for supplying electric power and signals along the length of said rail whereby an electronic price label mounted to said rail at any of a multiplicity of points can receive electric power and signals;

whereby an electronic price label having a lengthwise extending slot on one side and means for selectively engaging a ridge on an opposite side can be mounted to said rail by placing one of said ridges in said slot and rotating said label about a horizontal axis coincident with said slot until said means for selectively engaging a ridge engages the other ridge thereby removably mounting said electronic price label to said rail, wherein said rail further defines a lengthwise extending trough having an apex and upper and lower walls, said trough opening on said front side of said rail, said trough sized to accommodate substantially the head of a screw whereby self tapping screws can be screwed through said apex from said front side without said screw walking in the vertical direction and whereby screws screwed through said apex can be substantially countersunk within said trough.

9. The system of claim 8 wherein said rail defines an upward opening groove on said front side, said upward opening groove extending substantially from end to end, said rail further defining a downward opening groove on said front side, said downward opening groove being located above said upward opening groove, said trough being located vertically between said grooves and said grooves being located outward of said trough whereby a plastic insert can be held in place by said grooves and whereby said plastic insert can obscure the view of the trough.

10. A system for removably mounting electronic price labels to an edge of a horizontally extending shelf comprising:

a rail having a back side for mounting against said edge, a front side for mounting said electronic price labels, a top, a bottom and two ends, said rail having a top ledge extending outward from said top and a bottom ledge extending outward from the bottom, said top ledge having a ridge projecting downward and said bottom ledge having a ridge projecting upward, said rail being of substantially constant cross section when viewed from end to end; and means for supplying electric power and signals along the length of said rail whereby an electronic price label mounted to said rail at any of a multiplicity of points can receive electric power and signals;

whereby an electronic price label having a lengthwise extending slot on one side and means for selectively engaging a ridge on an opposite side can be mounted to said rail by placing one of said ridges in said slot and rotating said label about a horizontal axis coincident with said slot until said means for selectively engaging a ridge engages the other ridge thereby removably mounting said electronic price label to said rail, further comprising a plastic cover having inside and outside faces, said cover being pivotally coupled along a horizontal axis to said rail, said cover being sized and placed so that it closely covers electronic price labels removably mounted to said rail when in a closed position and provides substantially unhindered access to said labels when in an open position;

further comprising means for securing said plastic cover in said closed position;

wherein said plastic cover is flexible and further comprises a lengthwise extending ridge projecting from said inside face of said plastic cover whereby pressing inwards on said plastic cover when it is in a closed position causes said ridge to engage and activate a button on an electronic price label if located under an area being pressed.

11. A system for removably mounting electronic price labels to an edge of a horizontally extending shelf comprising:

a rail having a back side for mounting against said edge, a front side for mounting said electronic price labels, a top, a bottom and two ends, said rail having a top ledge extending outward from said top and a bottom ledge extending outward from the bottom, said top ledge having a ridge projecting downward and said bottom ledge having a ridge projecting upward, said rail being of substantially constant cross section when viewed from end to end; and means for supplying electric power and signals along the length of said rail whereby an electronic price label mounted to said rail at any of a multiplicity of points can receive electric power and signals;

whereby an electronic price label having a lengthwise extending slot on one side and means for selectively engaging a ridge on an opposite side can be mounted to said rail by placing one of said ridges in said slot and rotating said label about a horizontal axis coincident with said slot until said means for selectively engaging a ridge engages the other ridge thereby removably mounting said electronic price label to said rail, further comprising a plastic cover having inside and outside faces, said cover being pivotally coupled along a horizontal axis to said rail, said cover being sized and placed so that it closely covers electronic price labels removably mounted to said rail when in a closed position and provides substantially unhindered access to said labels when in an open position; further comprising means for securing said plastic cover in said closed position;

wherein said plastic cover is flexible, whereby pressing inwards on said plastic cover when it is in a closed position activates a protruding button on an electronic price label if located under an area being pressed.

12. A system for removably mounting electronic price labels to an edge of a horizontally extending shelf comprising:

a rail having a back side for mounting against said edge, a front side for mounting said electronic price labels, a top, a bottom and two ends, said rail having a top ledge extending outward from said top and a bottom ledge extending outward from the bottom, said top ledge having a ridge projecting downward and said bottom ledge having a ridge projecting upward, said rail being of substantially constant cross section when viewed from end to end; and means for supplying electric power and signals along the length of said rail whereby an electronic price label mounted to said rail at any of a multiplicity of points can receive electric power and signals;

whereby an electronic price label having a lengthwise extending slot on one side and means for selectively engaging a ridge on an opposite side can be mounted to said rail by placing one of said ridges in said slot and rotating said label about a horizontal axis coincident with said slot until said means for selectively engaging a ridge engages the other ridge thereby removably mounting said electronic price label to said rail, further comprising a plastic cover having inside and outside faces, said cover being pivotally coupled along a horizontal axis to said rail, said cover being sized and placed so that it closely covers electronic price labels removably mounted to said rail when in a closed position and provides substantially unhindered access to said labels when in an open position;

wherein said rail defines a lengthwise extending cylindrically shaped open channel extending along the bottom of said rail, said channel being open on said front side of said rail, said opening being open less than 180°, said plastic cover further comprising a substantially cylindrically shaped bead, said cylindrically shaped bead being sized to be pivotally held within said cylindrically shaped open channel, said cylindrically shaped bead being pivotally held by said cylindrically shaped open channel.

13. The system of claim 12 wherein said cylindrically shaped bead defines a substantially pie-slice shaped groove along its length whereby said cylindrically shaped bead can be compressed to fit through said opening into said cylindrically shaped open channel.

14. A system for removably mounting electronic price labels to an edge of a horizontally extending shelf comprising:

a rail having a back side for mounting against said edge, a front side for mounting said electronic price labels, a top, a bottom and two ends, said rail having a top ledge extending outward from said top and a bottom ledge extending outward from the bottom, said top ledge having a ridge projecting downward and said bottom ledge having a ridge projecting upward, said rail being of substantially constant cross section when viewed from end to end; and means for supplying electric power and signals along the length of said rail whereby an electronic price label mounted to said rail at any of a multiplicity of points can receive electric power and signals;

whereby an electronic price label having a lengthwise extending slot on one side and means for selectively engaging a ridge on an opposite side can be mounted to said rail by placing one of said ridges in said slot and rotating said label about a horizontal axis coincident with said slot until said means for selectively engaging a ridge engages the other ridge thereby removably mounting said electronic price label to said rail, further comprising a plastic cover having inside and outside faces, said cover being pivotally coupled along a horizontal axis to said rail, said cover being sized and placed so that it closely covers electronic price labels removably mounted to said rail when in a closed position and provides substantially unhindered access to said labels when in an open position;

wherein said rail has a lengthwise extending concavely curved upper surface and said plastic cover has a cylindrically shaped upper edge and wherein said cylindrically shaped upper edge is pivotally coupled against said concavely curved upper surface.

15. A system for removably mounting electronic price labels to an edge of a horizontally extending shelf comprising:

a rail having a back side for mounting against said edge, a front side for mounting said electronic price labels, a top, a bottom and two ends, said rail being of substantially constant cross section when viewed from end to end, said rail having a lengthwise extending knurled surface on said front side;

means for removably mounting electronic price labels to said front side; and means for supplying electric power and signals along the length of said rail whereby an electronic price label mounted to said rail at any of a multiplicity of points can receive electric power and signals;

whereby when an electronic price label having corresponding knurls on its back side is mounted to said rail, said corresponding knurls engage with said rail knurls thereby preventing said electronic price label from sliding lengthwise on the rail.

16. The system of claim 15 further comprising:

anvil means for supporting a portion of said rail on the back side of said knurled surface.

17. The system of claim 15 further comprising means for guiding a knurling tool along said knurled surface.

18. The system of claim 15 wherein said knurled surface is formed by a pressing tool which does not remove any material.

19. The system of claim 15 wherein said rail further defines a lengthwise extending trough having an apex and upper and lower walls, said trough opening on said front side of said rail, said trough sized to accommodate substantially the head of a screw whereby self tapping screws can be screwed through said apex from said front side without said screw walking in the vertical direction and whereby screws screwed through said apex can be substantially countersunk within said trough.

20. The system of claim 18 wherein said rail defines an upward opening groove on said front side, said upward opening groove extending substantially from end to end, said rail further defining a downward opening groove on said front side, said downward opening groove being located above said upward opening groove, said trough being located vertically between said grooves and said grooves being located outward of said trough whereby a flexible insert can be held in place by said grooves and whereby said plastic insert can obscure the view of the trough.

21. The system of claim 15 further comprising:

upper and lower lengthwise extending ribs on said back side.

22. The system of claim 21 wherein said lower rib extends at least partially downward whereby said lower rib can better support said rail with respect to downward forces applied to said rail.

23. The system of claim 15 further comprising means for holding one edge of a carton whereby the opposite edge can be held against the midsection of a stocking person thereby increasing the stocking efficiency of said stocking person.

24. The system of claim 15 further comprising a plastic cover having inside and outside faces, said cover being pivotally coupled along a horizontal axis to said rail, said cover being sized and placed so that it closely covers electronic price labels removably mounted to said rail when in a closed position and provides substantially unhindered access to said labels when in an open position.

25. The system of claim 24 further comprising means for securing said plastic cover in said closed position.

26. The system of claim 24 wherein said plastic cover is flexible and further comprises a lengthwise extending ridge projecting from said inside face of said plastic cover whereby pressing inwards on said plastic cover when it is in a closed position causes said ridge to engage said activate a button on one of the electronic price labels if located under an area being pressed.

27. The system of claim 24 wherein said rail defines a lengthwise extending cylindrically shaped open channel extending along the bottom of said rail, said channel being open on said front side of said rail, said opening being open less than 180°, said plastic cover further comprising a substantially cylindrically shaped bead, said cylindrically shaped bead being sized to be pivotally held within said cylindrically shaped open channel, said cylindrically shaped bead being pivotally held by said cylindrically shaped open channel.

28. The system of claim 27 wherein said cylindrically shaped bead defines a substantially pie-slice shaped groove along its length whereby said cylindrically shaped bead can be compressed to fit through said opening into said cylindrically shaped open channel.

29. The system of claim 24 wherein said rail has a lengthwise extending concavely curved upper surface and said plastic cover has a cylindrically shaped upper edge and wherein said cylindrically shaped upper edge is pivotally coupled against said concavely curved upper surface.

30. A system for removably mounting electronic price labels to an edge of a horizontally extending shelf comprising:

a rail having a back side for mounting against said edge, a front side for mounting said electronic price labels, a top, a bottom and two ends, said rail having a top ledge extending outward from said top and a bottom ledge extending outward from the bottom, said top ledge having a ridge projecting downward and said bottom ledge having a ridge projecting upward, said rail being of substantially constant cross section when viewed from end to end, said rail having a lengthwise extending knurled surface on said front side, wherein knurls of said knurled surface extend in a direction between the horizontal and the vertical directions; and means for supplying electric power and signals along the length of said rail whereby an electronic price label mounted to said rail at any of a multiplicity of points can receive electric power and signals;

whereby an electronic price label having top, bottom, front and back sides, and having corresponding knurls on the back side, the knurls being angled relative to the vertical, and having a lengthwise extending slot on one of said top and bottom sides and means for selectively engaging a ridge on the side opposite from said slot can be mounted to said rail by placing one of said ridges in said slot and rotating said label about a horizontal axis coincident with said slot until said means for selectively engaging a ridge engages the other ridge thereby removably mounting said electronic price label to said rail; and whereby when said electronic price label is mounted to said rail, said corresponding knurls slidably engage with said rail knurls thereby moving said electronic price label slightly lengthwise along the rail.

31. The system of claim 30 further comprising:

anvil means for supporting a portion of said rail on the back side of said knurled surface.

32. The system of claim 30 further comprising means for guiding a knurling tool along said knurled surface.

33. The system of claim 30 wherein said knurled surface is formed by a pressing tool which does not remove any material.

34. The system of claim 30 wherein said rail further defines a lengthwise extending trough having an apex and upper and lower walls, said trough opening on said front side of said rail, said trough sized to accommodate substantially the head of a screw whereby self tapping screws can be screwed through said apex from said front side without said screw walking in the vertical direction and whereby screws screwed through said apex can be substantially countersunk within said trough.

35. The system of claim 34 wherein said rail defines an upward opening groove on said front side, said upward opening groove extending substantially from end to end, said rail further defining a downward opening groove on said front side, said downward opening groove being located above said upward opening groove, said trough being located vertically between said grooves and said grooves being located outward of said trough whereby a plastic insert can be held in place by said grooves and whereby said plastic insert can obscure the view of the trough.

36. The system of claim further comprising:

upper and lower lengthwise extending ribs on said back side.

37. The system of claim 36 wherein said lower rib extends at least partially downward whereby said lower rib can better support said rail with respect to downward forces applied to said rail.

38. The system of claim 30 further comprising means for holding one edge of a carton whereby the opposite edge can be held against the midsection of a stocking person thereby increasing the stocking efficiency of said stocking person.

39. The system of claim 30 further comprising a plastic cover having inside and outside faces, said cover being pivotally coupled along a horizontal axis to said rail, said cover being sized and placed so that it closely covers electronic price labels removably mounted to said rail when in a closed position and provides substantially unhindered access to said labels when in an open position.

40. The system of claim 39 further comprising means for securing said plastic cover in said closed position.

41. The system of claim 39 wherein said plastic cover is flexible and further comprises a lengthwise extending ridge projecting from said inside face of said plastic cover whereby pressing inwards on said plastic cover when it is in a closed position causes said ridge to engage and activate a button on one of the electronic price labels if located under an area being pressed.

42. The system of claim 39 wherein said plastic cover is flexible, whereby pressing inwards on said plastic cover when it is in a closed position activates a button on one of the electronic price labels if located under an area being pressed.

43. The system of claim 42 wherein said cylindrically shaped bead defines a substantially pie-slice shaped groove along its length whereby said cylindrically shaped bead can be compressed to fit through said opening into said cylindrically shaped open channel.

44. The system of claim 39 wherein said rail defines a lengthwise extending cylindrically shaped open channel extending along the bottom of said rail, said channel being open on said front side of said rail, said opening being open less than 180°, said plastic cover further comprising a substantially cylindrically shaped bead, said cylindrically shaped bead being sized to be pivotally held within said cylindrically shaped open channel, said cylindrically shaped bead being pivotally held by said cylindrically shaped open channel.

45. The system of claim 39 wherein said rail has a lengthwise extending concavely curved upper surface and said plastic cover has a cylindrically shaped upper edge and wherein said cylindrically shaped upper edge is pivotally coupled against said concavely curved upper surface.

46. A system for removably mounting electronic price labels to an edge of a horizontally extending shelf comprising:

a rail having a back side for mounting against said edge, a front side for mounting said electronic price labels, a top, a bottom and two ends, said rail being of substantially constant cross section when viewed from end to end;

means for removably mounting an electronic price label on the front side of said groove;

means for supplying electric power and signals along the length of said rail whereby an electronic price label mounted to said rail at any of a multiplicity of points can receive electric power and signals; and means for holding one edge of a carton whereby the opposite edge can be held against the midsection of a stocking person thereby increasing the stocking efficiency of said stocking person;

wherein said rail further defines a lengthwise extending trough having an apex and upper and lower walls, said trough opening on said front side of said rail, said trough sized to accommodate substantially the head of a screw whereby self tapping screws can be screwed through said apex from said front side without said screw walking in the vertical direction and whereby screws screwed through said apex can be substantially countersunk within said trough.

47. The system of claim 46 wherein said rail defines an upward opening groove on said front side, said upward opening groove extending substantially from end to end, said rail further defining a downward opening groove on said front side, said downward opening groove being located above said upward opening groove, said trough being located vertically between said groove and said grooves being located outward of said trough whereby a plastic insert can be held in place by said grooves and whereby said plastic insert can obscure the view of the trough.

48. A system for removably mounting electronic price labels to an edge of a horizontally extending shelf comprising:

a rail having a back side for mounting against said edge, a front side for mounting said electronic price labels, a top, a bottom and two ends, said rail being of substantially constant cross section when viewed from end to end;

means for removably mounting an electronic price label on the front side of said groove;

means for supplying electric power and signals along the length of said rail whereby an electronic price label mounted to said rail at any of a multiplicity of points can receive electric power and signals; and means for holding one edge of a carton whereby the opposite edge can be held against the midsection of a stocking person thereby increasing the stocking efficiency of said stocking person;

further comprising a plastic cover having inside and outside faces, said cover being pivotally coupled along a horizontal axis to said rail, said cover being sized and placed so that it closely covers electronic price labels removably mounted to said rail when in a closed position and provides substantially unhindered access to said labels when in an open position;

wherein said plastic cover is flexible and further comprises a lengthwise extending ridge projecting from said inside face of said plastic cover whereby pressing inwards on said plastic cover when it is in a closed position causes said ridge to engage and activate a button on one of the electronic price labels if located under an area being pressed.

49. A system for removably mounting electronic price labels to an edge of a horizontally extending shelf comprising:

a rail having a back side for mounting against said edge, a front side for mounting said electronic price labels, a top, a bottom and two ends, said rail being of substantially constant cross section when viewed from end to end;

means for removably mounting an electronic price label on the front side of said groove;

means for supplying electric power and signals along the length of said rail whereby an electronic price label mounted to said rail at any of a multiplicity of points can receive electric power and signals; and means for holding one edge of a carton whereby the opposite edge can be held against the midsection of a stocking person thereby increasing the stocking efficiency of said stocking person;

further comprising a plastic cover having inside and outside faces, said cover being pivotally coupled along a horizontal axis to said rail, said cover being sized and placed so that it closely covers electronic price labels removably mounted to said rail when in a closed position and provides substantially unhindered access to said labels when in an open position;

wherein said plastic cover is flexible, whereby pressing inwards on said plastic cover when it is in a closed position activates a button on one of the electronic price labels if located under an area being pressed.

50. A system for removably mounting electronic price labels to an edge of a horizontally extending shelf comprising:

a rail having a back side for mounting against said edge, a front side for mounting said electronic price labels, a top, a bottom and two ends, said rail being of substantially constant cross section when viewed from end to end;

means for removably mounting an electronic price label on the front side of said groove;

means for supplying electric power and signals along the length of said rail whereby an electronic price label mounted to said rail at any of a multiplicity of points can receive electric power and signals; and means for holding one edge of a carton whereby the opposite edge can be held against the midsection of a stocking person thereby increasing the stocking efficiency of said stocking person;

further comprising a plastic cover having inside and outside faces, said cover being pivotally coupled along a horizontal axis to said rail, said cover being sized and placed so that it closely covers electronic price labels removably mounted to said rail when in a closed position and provides substantially unhindered access to said labels when in an open position;

wherein said rail defines a lengthwise extending cylindrically shaped open channel extending along the bottom of said rail, said channel being open on said front side of said rail, said opening being open less than 180°, said plastic cover further comprising a substantially cylindrically shaped bead, said cylindrically shaped bead being sized to be pivotally held within said cylindrically shaped open channel, said cylindrically shaped bead being pivotally held by said cylindrically shaped open channel.

51. The system of claim 50 wherein said cylindrically shaped bead defines a substantially pie-slice shaped groove along its length whereby said cylindrically shaped bead can be compressed to fit through said opening into said cylindrically shaped open channel.

52. A system for removably mounting electronic price labels to an edge of a horizontally extending shelf comprising:

a rail having a back side for mounting against said edge, a front side for mounting said electronic price labels, a top, a bottom and two ends, said rail being of substantially constant cross section when viewed from end to end;

means for removably mounting an electronic price label on the front side of said groove;

means for supplying electric power and signals along the length of said rail whereby an electronic price label mounted to said rail at any of a multiplicity of points can receive electric power and signals; and means for holding one edge of a carton whereby the opposite edge can be held against the midsection of a stocking person thereby increasing the stocking efficiency of said stocking person;

further comprising a plastic cover having inside and outside faces, said cover being pivotally coupled along a horizontal axis to said rail, said cover being sized and placed so that it closely covers electronic price labels removably mounted to said rail when in a closed position and provides substantially unhindered access to said labels when in an open position;

wherein said rail has a lengthwise extending concavely curved upper surface and said plastic cover has a cylindrically shaped upper edge and wherein said cylindrically shaped upper edge is pivotally coupled against said concavely curved upper surface.

53. A system for removably mounting electronic price labels to an edge of a horizontally extending shelf comprising:

a rail having a back side for mounting against said edge, a front side for mounting said electronic price labels, a top, a bottom and two ends, said rail being of substantially constant cross section when viewed from end to end;

means for removably mounting an electronic price label in front of said grooves;

means for supplying electric power and signals along the length of said rail whereby an electronic price label mounted to said rail at any of a multiplicity of points can receive electric power and signals;

a plastic cover having inside and outside faces, said plastic cover being pivotally coupled along a horizontal axis to said rail, said cover being sized and placed so that it closely covers electronic price labels removably mounted to said rail when in a closed position and provides substantially unhindered access to said labels when in an open position;

wherein said plastic cover is flexible and further comprises a lengthwise extending ridge projecting from said inside face of said plastic cover whereby pressing inwards on said plastic cover when it is in a closed position causes said ridge to engage and activate a button on one of the electronic price labels if located under an area being pressed.

54. A system for removably mounting electronic price labels to an edge of a horizontally extending shelf comprising:

a rail having a back side for mounting against said edge, a front side for mounting said electronic price labels, a top, a bottom and two ends, said rail being of substantially constant cross section when viewed from end to end;

means for removably mounting an electronic price label in front of said grooves;

means for supplying electric power and signals along the length of said rail whereby an electronic price label mounted to said rail at any of a multiplicity of points can receive electric power and signals;

a plastic cover having inside and outside faces, said plastic cover being pivotally coupled along a horizontal axis to said rail, said cover being sized and placed so that it closely covers electronic price labels removably mounted to said rail when in a closed position and provides substantially unhindered access to said labels when in an open position;

wherein said plastic cover is flexible, whereby pressing inwards on said plastic cover when it is in a closed position activates a protruding button on an electronic price label if located under an area being pressed.

55. A system for removably mounting electronic price labels to an edge of a horizontally extending shelf comprising:

a rail having a back side for mounting against said edge, a front side for mounting said electronic price labels, a top, a bottom and two ends, said rail being of substantially constant cross section when viewed from end to end;

means for removably mounting an electronic price label in front of said grooves;

means for supplying electric power and signals along the length of said rail whereby an electronic price label mounted to said rail at any of a multiplicity of points can receive electric power and signals;

a plastic cover having inside and outside faces, said plastic cover being pivotally coupled along a horizontal axis to said rail, said cover being sized and placed so that it closely covers electronic price labels removably mounted to said rail when in a closed position and provides substantially unhindered access to said labels when in an open position;

wherein said rail defines a lengthwise extending cylindrically shaped open channel extending along the bottom of said rail, said channel being open on said front side of said rail, said opening being open less than 180°, said plastic cover further comprising a substantially cylindrically shaped bead, said cylindrically shaped bead being sized to be pivotally held within said cylindrically shaped open channel, said cylindrically shaped bead being pivotally held by said cylindrically shaped open channel.

56. The system of claim 55 wherein said cylindrically shaped bead defines a substantially pie-slice shaped groove along its length whereby said cylindrically shaped bead can be compressed to fit through said opening into said cylindrically shaped open channel.

57. A system for removably mounting electronic price labels to an edge of a horizontally extending shelf comprising:

a rail having a back side for mounting against said edge, a front side for mounting said electronic price labels, a top, a bottom and two ends, said rail being of substantially constant cross section when viewed from end to end;

means for removably mounting an electronic price label in front of said grooves;

means for supplying electric power and signals along the length of said rail whereby an electronic price label mounted to said rail at any of a multiplicity of points can receive electric power and signals;

a plastic cover having inside and outside faces, said plastic cover being pivotally coupled along a horizontal axis to said rail, said cover being sized and placed so that it closely covers electronic price labels removably mounted to said rail when in a closed position and provides substantially unhindered access to said labels when in an open position;

wherein said rail has a lengthwise extending concavely curved upper surface and said plastic cover has a cylindrically shaped upper edge and wherein said cylindrically shaped upper edge is pivotally coupled against said concavely curved upper surface.

58. A system for removably mounting electronic price labels to an edge of a horizontally extending shelf comprising:

a rail having a back side for mounting against said edge, a front side for mounting said electronic price labels, a top, a bottom end two ends, said rail being of substantially constant cross section when viewed from end to end;

means for removably mounting an electronic price label to said front side of said rail;

means for supplying electric power and signals along the length of said rail whereby an electronic price label mounted to said rail at any of a multiplicity of points can receive electric power and signals; and upper and lower lengthwise extending ribs on said back side, and a protrusion between the upper and lower ribs, disposed so that the rearmost extent of the upper and lower ribs, and of the protrusion, are all substantially coplanar.

59. The system of claim 58 wherein said lower rib extends at least partially downward whereby said lower rib can better support said rail with respect to downward forces applied to said rail.

60. The system of claim 58 further comprising a resilient insert, the rail further comprising channel means adjacent one of the ribs disposed to receive the resilient insert, the resilient insert and the other of the ribs shaped for positive engagement with a "C" channel.

* * * * *

UNITED STATES PATENT AND TRADEMARK OFFICE

CERTIFICATE OF CORRECTION

PATENT NO. : 5,553,412
APPLICATION NO. : 08/036950
DATED : September 10, 1996
INVENTOR(S) : Briechle et al.

It is certified that error appears in the above-identified patent and that said Letters Patent is hereby corrected as shown below:

On the Title page,

Item [74], "Oppendahl" should read -- Oppedahl --

Signed and Sealed this

Eighteenth Day of May, 2010

David J. Kappos

David J. Kappos
*Director of the United States Patent and Trademark Office*